US006964709B2

(12) United States Patent
Matsumoto et al.

(10) Patent No.: US 6,964,709 B2
(45) Date of Patent: Nov. 15, 2005

(54) ACOUSTIC SOOT BLOWER, AND METHOD FOR OPERATING THE SAME

(75) Inventors: Teruaki Matsumoto, Hiroshima (JP); Ryousuke Yamaguchi, Hiroshima (JP); Yasuo Nishihara, Hiroshima (JP)

(73) Assignee: Babcock-Hitachi Kabushiki Kaisha, Minatoku (JP)

( * ) Notice: Subject to any disclaimer, the term of this patent is extended or adjusted under 35 U.S.C. 154(b) by 535 days.

(21) Appl. No.: 09/953,380

(22) Filed: Sep. 13, 2001

(65) Prior Publication Data

US 2002/0070073 A1 Jun. 13, 2002

Related U.S. Application Data

(63) Continuation of application No. PCT/JP01/00135, filed on Jan. 12, 2001, now abandoned.

(30) Foreign Application Priority Data

Jan. 14, 2000 (JP) ..... 2000-007029
Mar. 14, 2000 (JP) ..... 2000-070254

(51) Int. Cl.[7] ..... B08B 7/00; B08B 7/04

(52) U.S. Cl. ..... 134/1; 134/18; 134/22.18; 15/316.1; 15/319

(58) Field of Search ..... 136/1, 18, 22.18, 136/34, 37, 42; 15/316.1, 317, 318.1, 319

(56) References Cited

U.S. PATENT DOCUMENTS 3,137,278 A * 6/1964 Thayer ..... 122/392
3,901,081 A * 8/1975 Adiutori ..... 374/29
4,193,158 A * 3/1980 Blaskowski ..... 15/317

FOREIGN PATENT DOCUMENTS

JP 09061088 A 3/1997
JP 09061089 A 3/1997
JP 09061090 A 3/1997
JP 11179310 A 7/1999
JP 11223328 A 8/1999

OTHER PUBLICATIONS

Schimmoller, Brian K., "Tuning in to Accoustic", *Power Engineering*, Jul. 1999.

* cited by examiner

*Primary Examiner*—Alexander Markoff
(74) *Attorney, Agent, or Firm*—Intellectual Property Law Group LLP; Otto O. Lee; Juneko Jackson

(57) ABSTRACT

The sonic soot blower includes a sonic wave oscillator that oscillates sonic waves by compressed air or steam, a frequency-regulating portion that varies the frequencies of the sonic waves oscillated by the above-described sonic wave oscillator, a resonance tube that resonates the oscillated sonic waves, and a horn that amplifies the same, wherein powdery dust adhered to members installed inside a boiler furnace, etc., are removed, and are prevented from adhering to the above-described members. The above-described frequency-regulating portion is a gas mixer which is connected to the upstream side of the sonic wave oscillator and is provided with two or more gas conducting flow channels for conducting a compressive gas whose temperatures and/or densities are different from each other, or a slide mechanism that varies the length of the above-described resonance tube. Since the sonic soot blower is able to oscillate sonic waves while regulating the oscillation frequency so as to be suited to the operating conditions of the boiler, it becomes possible to effectively remove ash from the heat transmission tubes and to effectively prevent the same from adhering thereto over a wide range of operating conditions of soot blower-installed equipment (such as a boiler).

34 Claims, 26 Drawing Sheets

(a)

(b)

(a)

(b)

(a)

(b)

ACOUSTIC SOOT BLOWER, AND METHOD FOR OPERATING THE SAME

This is a continuation of International Application PCT/JP01/00135, with an international filing date of Jan. 12, 2001 and now abandoned.

TECHNICAL FIELD OF THE INVENTION

The present invention relates to an acoustic (hereafter: sonic) soot blower in which a compressive gas is used as a drive source of sonic wave oscillation, and a method for operating the same. In particular, the invention pertains to a cleaning sonic soot blower that can remove, by sonically oscillating a gas body existing in the tubular member, powdery dust, etc., such as ash adhered to and accumulated at tubular members that are installed in soot blower-installed equipment such as a boiler, a combustion furnace, an incinerator, an independent superheater, an independent economizer, various types of heat exchangers, various types of plants, and/or various types of industrial apparatuses.

Further, the sonic soot blower of the invention also functions to prevent powdery dusts, etc., such as ash from adhering to the members of the soot blower-installed equipment.

BACKGROUND OF THE INVENTION

A description is given, using a coal-burning boiler furnace as an example of the soot blower-installed equipment. Since a combustion gas for a coal-burning boiler furnace contains a great deal of ash, ash is likely to adhere to the surface of the members disposed inside the boiler furnace, and in particular, ash adheres to the outer surface of heat transmission tubes disposed in the boiler furnace. Further, adhering ash is deposited in layers.

FIG. 10 is a view showing a general construction of the inside of the boiler furnace 1. As shown in FIG. 10, a group 3 of suspension type heat transmission tubes is installed on the ceiling of the boiler furnace 1, and a group 4 of horizontally installed heat transmission tubes are disposed on the rearward heat transmission section. The group 3 of suspension type heat transmission tubes and the group 4 of horizontally installed heat transmission tubes are, respectively, composed of a number of heat transmission tubes, and the surfaces of these groups 3 and 4 of heat transmission tubes are in contact with a high temperature combustion gas containing combustion ash.

Therefore, combustion ash adheres to and accumulates at (hereinafter, adhesion and accumulation are merely called "adhesion") the surfaces of heat transmission tubes that constitute these groups 3 and 4 of heat transmission tubes. If the combustion ash excessively adheres to the surfaces of the above-described heat transmission tubes, heat transmission of water or steam fluid, which flows from the high temperature combustion gas to groups 3 and 4 of the heat transmission tubes, is hindered to lower the capacity of a boiler apparatus. Also, the greater the amount of ash that adheresto the above-described heat transmission tubes, the greater the waste combustion gas temperature becomes, which is expelled from the boiler furnace 1.

Therefore, a soot blower that is installed inside a boiler furnace 1 is usually operated periodically (a steam injection type soot blower has frequently been employed) in order to blow out combustion ash that adheres on the surface of the above-described heat transmission tubes, whereby the heat transmission capacity is prevented from lowering.

Recently, a sonic soot blower 6, in which sonic waves are utilized, shown in FIG. 10 has been applied to a boiler apparatus. A plurality of sonic soot blowers 6 is installed on the furnace wall at portions where groups 3 and 4 of heat transmission tubes of the boiler furnace 1 are installed.

The sonic soot blowers 6 oscillate sonic waves of high sonic pressure to a space surrounded by the furnace wall of the boiler furnace 1 and vibrate a combustion gas, etc., wherein minute displacement is given to the combustion ash that has adhered to the surfaces of the respective heat transmission tubes of groups 3 and 4 of the heat transmission tubes, and the combustion ash is finally dropped from the surfaces of the heat transmission tubes. In addition, in the process of oscillating the above-described sonic waves, there is another effect by which combustion ash is prevented from adhering to the surfaces of the heat transmission tubes.

The sonic soot blower 6 includes a sonic wave oscillator, in which an oscillation plate oscillates sonic waves by using high pressure air, etc., a resonance tube that resonates the sonic waves oscillated by the corresponding sonic wave oscillator at a specified frequency, and a horn to amplify them. The sonic soot blower 6 oscillates said amplified sonic waves into the boiler furnace 1 and forms stationary waves by exciting columnar oscillations in the boiler furnace 1 with the sonic waves. By heightening the sound pressure in the furnace 1 with the corresponding stationary waves, combustion ash adhered to the surfaces of the heat transmission tubes is removed and is thus prevented from adhering to the heat transmission tubes.

Since the combustion gas temperature changes due to an operation load of the boiler in the boiler furnace 1, the columnar resonance frequency in the furnace changes. In order to effectively remove ash by using the sonic soot blower 6, it is necessary to maintain the in-furnace columnar resonance required regardless of the operating conditions of the boiler. However, since the oscillation frequency of a sonic wave oscillator used in a prior art sonic soot blower 6 is constant, the in-furnace columnar resonance is established only when the gas temperature conditions in the furnace correspond to the above-described transmission frequency, wherein the sound pressure is increased in the furnace, and the effect of removing ash is increased. When no in-furnace columnar resonance is established as the temperature conditions of the exhaust gas in the furnace changes, the sound pressure is lowered, and the effect of removing ash is greatly reduced. Therefore, the prior art soot blower 6 had a problem in that it could not be operated satisfactorily in a wide range of operating conditions of a boiler.

Accordingly, it is the first object of the invention to enable a sonic soot blower to function in a wide range of operating conditions for soot blower-installed equipment such as a boiler by varying the sonic wave oscillation frequency by a simple method.

Also, where the sonic soot blower 6 is installed at the furnace wall of, for example, a boiler furnace 1, no sound pressure distribution in the furnace width direction of the boiler furnace could be confirmed when stationary waves occurred in the boiler furnace 1 by the sonic soot blower 6 are formed, and no stationary waves could also be confirmed. The reason is that a sound pressure level measurement microphone cannot be inserted into the inside of the boiler furnace because the inside of the boiler furnace is at a high temperature during the operation thereof. In addition, even if the sound pressure detector secured at the furnace wall of, for example, the boiler furnace 1 can measure the sound pressure level, only the sound pressure level on the furnace wall can be measured, wherein it is impossible to discriminate whether it was the sound pressure when the stationary waves could be formed or when the stationary waves could not be formed.

The second object of the invention is to enable the confirmation of the stationary wave frequency of the sonic waves inside the corresponding apparatus when operating the sonic soot blower in the soot blower-installed equipment, to enable the control of removal of powdery dust, etc., on the members that constitute the soot blower-installed equipment, to prevent powdery dust, etc., from adhering to the above-described members.

Further, some of the sonic soot blowers 6 installed on the wall surface of a boiler furnace 1 have an opening whose diameter is approx. 500 mm. The above-described opening provided at the furnace wall is shaped so that a gas flow from the inside of the furnace is piled up. The coal-burning boiler furnace contains much powdery dust such as ash in a gas produced by burning of coal, etc. Therefore, if a coal-burning boiler has been operated for a long period, coal ash invades the inside of the sonic soot blower through the above-described opening and accumulates and may close the above-described opening. Further, the temperature of the casing, in which a sonic wave oscillator of the sonic soot blower and a horn thereof are accommodated, increases due to radiant heat of a high temperature gas, and a problem arises in the strength of the corresponding casing.

Also, since there are many cases in which the sonic soot blower 6 is installed on the wall of a boiler furnace, the sonic soot blower 6 is cooled down (the boiler furnace 1 is operated in a reduced pressure level less than the atmospheric air for safety) by compressed air being sucked into the furnace 1 through the above-described opening via the sonic soot blower. It is necessary to attach approximately 30 units of sonic soot blowers 6 to a large output coal-burning boiler. As the number of sonic soot blowers 6 installed increases, the capacity of a compressor for compressed air increases accordingly, and suction of a great deal of compressed air becomes a factor of disturbance for the control of oxygen concentration in the boiler furnace 1. In addition, if the temperature of compressed air for cooling is lower than the temperature of fluid (such as water, steam or their mixture) in the heat transmission tubes installed in the furnace 1, the above-mentioned fluid that is being heated is cooled.

The third object of the invention is to develop and provide a means for easily cooling the inside of the accommodation casing of the sonic soot blower, to cool the accommodation casing itself of the sonic soot blower and to prevent powdery dust such as ash from adhering to the opening of the furnace wall which the sonic soot blower faces.

Further, where the sonic soot blower 6 is installed on the wall surface of the boiler furnace, the following problems are observed.

Although the combustion gas temperature in the boiler furnace 1 near the position where the sonic soot blower 6 is installed is 300 through 400° C., the pressure in the furnace 1 is adjusted to be lower (by −100 through −50 mmAq) than the atmospheric pressure for the safety when operating the furnace. Therefore, the high temperature in-furnace gas does not flow in the sonic soot blower 6 whose pressure is less than the atmospheric pressure. However, where a difference in pressure between in the furnace 1 and in the sonic soot blower 6 is removed when stopping the operation of the boiler, and the gas temperature in the sonic soot blower 6 is remarkably lower than the in-furnace gas temperature (immediately after the boiler operation stops), humidity (or water) in the gas constituents begins condensing in the sonic soot blower 6. Therefore, drain containing highly corrosive constituents adheres to the inner wall in the sonic soot blower or members installed in the sonic soot blower 6, resulting in corrosion of these inner walls and/or members.

In particular, if devices in the casing in which a sonic wave oscillator equipped with a frequency-regulating portion consisting of accurate mechanical components incorporated is corroded even a little, the frequency-regulating portion will malfunction and cause the operation of the sonic soot blower 6 to stop.

The fourth object of the invention is to provide a countermeasure to prevent dirty gases in soot blower-installed equipment from entering the sonic soot blower.

Also, soot blower-installed equipment to which a sonic soot blower is applied is provided with a plurality of member stages. If the equipment is located in an area where gases containing dust such as ash flow, the accumulation of the dust such as ash may be quickened unless dust such as ash is effectively removed to prevent it from adhering to the plurality of member stages.

The fifth object of the invention is to effectively remove powdery dust such as ash from the soot blower-installed equipment in which a plurality of member stages are provided and to which dust such as ash may likely adhere, and/or to prevent adherence of powdery dust such as ash.

SUMMARY OF THE INVENTION

A sonic soot blower used for the invention is a frequency-variable type or frequency-fixed type sonic soot blower that is provided with a sonic wave oscillator internally incorporating an oscillation plate for making oscillation by using a compressive gas, a resonance tube for resonating the sonic waves oscillated by the corresponding sonic wave oscillator, and a horn for amplifying the same, wherein, by utilizing a phenomenon of increasing the sonic pressure by generating columnar resonance in soot blower-installed equipment, by oscillating sonic waves in the soot blower-installed equipment of a boiler furnace, etc., and powdery dust adhered to members of the equipment is removed or powdery dust is prevented from adhering to the above-described members.

The first object of the invention can be achieved by incorporating the following frequency-variable type sonic soot blower in the soot blower-installed equipment.

One or more sonic wave oscillating frequency-variable type sonic soot blowers that are provided with a frequency regulating section which can generates a plurality of columnar resonance frequencies while continuously varying them, are prepared. Respective sonic soot blowers are disposed at one or more portions in soot blower-installed equipment, and oscillation frequencies suited to the operating conditions of the soot blower-installed equipment, are oscillated at the corresponding disposed positions by the respective sonic soot blower.

In the present invention, the following three types of sonic soot blowers are employed as a sonic soot blower equipped with the above-described frequency regulating section.

(a) A sonic soot blower provided with a gas mixer, as the frequency regulating section, which is provided with two or more gas inlet flow channels that conduct compressive gases having different temperatures or densities from each other to the upstream side of the sonic wave oscillator. The sonic soot blower (a) is constructed so that no slide mechanism is secured in the next sonic soot blower (b) is provided in the resonance tube.

(b) A sonic soot blower equipped, as the frequency regulating device, with a resonance tube equipped with a slide mechanism, which varies its length, between the sonic wave oscillator and horn.

(c) A sonic soot blower including a resonance tube having the above-described slide mechanism and a gas mixer in which two or more gas inlet channels that conduct compressive gases having different temperatures or densities from each other to the upstream side of the sonic wave oscillator.

Herein, a description is given of a method for varying the sonic wave oscillation frequency of the sonic soot blower according to the invention.

First, a description is given of the principle of a sonic soot blower that varies the oscillation frequency by temperature control of the compressive gases, which is one of the above-described systems (a).

The following relational expression (1) can be established between the sonic velocity and oscillation frequency.

$$C=f\lambda \tag{1}$$

where C is the sonic velocity (m/s) of a gas (compressive gas) at a temperature (t)° C., f is the oscillation frequency (Hz), and λ is the wavelength (m) of the oscillation frequency.

Also, the sonic velocity (C) can be expressed by the following formula (2).

$$C=\sqrt{(\gamma p/\rho)} \tag{2}$$

$$\rho=\rho_o\times\{273/(273+t)\} \tag{3}$$

where γ is the specific heat ratio=Constant-pressure specific heat Cp/Constant-capacity specific heat Cv, P is the pressure ($N/m^2$) of a gas at the outlet of the oscillation plate, ρ is the density ($kg/m^3$) of a gas, $\rho_o$ is the density (kg (Normal)/$m^3$) of a gas in a normal state, and t is the temperature (° C.) of a gas (compressive gas).

Using air as a compressive gas for oscillating sonic waves on the basis of the above-described expressions (1), (2) and (3), the sonic velocity (C) can be varied by changing the temperature (t).

At this time, if the length of the resonance tube is constant, the wavelength (λ) of the frequency becomes constant when the columnar resonance is carried out in the resonance tube and horn. Therefore, it is possible to vary the oscillation frequency (f) by changing the temperature (t) of a gas (compressive gas) as in the following expression (4).

$$\begin{aligned} f &= C/\lambda \\ &= \sqrt{(\gamma P/\rho)}\ /\lambda \\ &= \left[\sqrt{(\gamma P/\rho_o)}\ \times\sqrt{\{273+t)/273\}}\right]/\lambda \\ &\quad (\lambda = \text{Constant}) \end{aligned} \tag{4}$$

In the case of the soot blower according to the above-described system (a), as the method for varying the temperature (t) of a gas (compressive gas), a part of the compressive gas for driving the oscillation plate of the sonic wave oscillator is heated by using, as a heat source, radiant heat from the soot blower-installed equipment such as a boiler furnace, in order to obtain the heated gas. The heated gas is mixed with the above-described compressive gas of a relatively low temperature by the gas mixer to obtain a mixed gas having a compressive gas temperature (t) at which the target oscillation frequency (f) is obtained, and the oscillation frequency (f) is adjusted using the mixed gas.

Next, a description is given of the principle of a sonic soot blower, which is another example of the above-described system (a) of the invention and varies the oscillation frequency by controlling the density of a compressive gas.

The sonic velocity (C) and oscillation frequency (f) are defined by the above-described expression (1). However, the above-described expression (2) can be established among the sonic velocity (C), specific heat ratio (γ) of a gas, and pressure (P). Therefore, in a state where the range of fluctuation of the gas temperature is suppressed to be small by mixing two or more gases having different densities (ρ) from each other, the oscillation frequency (f) of the soot blower can be varied.

For example, it is possible to vary the oscillation frequency (f) by mixing air and steam together in a state where the fluctuation of gas temperature is suppressed and the range of that fluctuation is minimized. As a detailed example, a description is given of the fluctuation of the oscillation frequency (f) in the case where air at 0° C. is mixed with steam at 100° C.

Gas A (Air): Density $\rho_A$, Specific heat ratio $\gamma_A$ $\rho_A$=1.293 $kg/m^3 \leftarrow \gamma_A$=1.400 0° C.

Gas B (Steam): Density $\rho_B$, Specific heat ratio $\gamma_B$ $\rho_B$=0.598 $Kg/m^3 \leftarrow \gamma_B$=1.283 100° C.

By mixing air with steam, whose densities described above are different from each other, a width Δf=40 Hz of fluctuation of the oscillation frequency can be obtained at a width Δt=100° C. of the fluctuation in temperature. In comparison with Δf=40 Hz obtained at Δt=280° C. in the case of the gas of the same density, it is found that the oscillation frequency (f) is varied in a state where the width of fluctuation of the gas temperature is suppressed to be made small.

However, the oscillation frequency (f) that causes in-furnace columnar resonance in the direction of the width of the furnace of the soot blower-installed equipment of a boiler furnace, etc., is generally obtained by the following expression (5).

$$f=n\times C'/2\times\text{furnace width} \tag{5}$$

where f is the columnar resonance frequency (oscillation frequency) (Hz), C' is the sonic velocity (m/s) at the in-furnace gas temperature (t')° C., and n is the resonance order.

Therefore, regarding the sonic waves generated in the soot blower-installed equipment, a plurality of stationary waves exist, and it has been confirmed that the columnar resonance frequency (f) in the soot blower-installed equipment brings about the highest sonic pressure where the columnar resonance order (n) is between the $5^{th}$ order and the $11^{th}$ order.

Since the higher the gas temperature (t') (for example, the combustion gas temperature in the boiler furnace) in the soot blower-installed equipment is, the faster the sonic velocity (C') in the furnace becomes, it is necessary, as has been made clear from the above-described expression (5), for the oscillation frequency (f) to increase to excite the columnar resonance order (n) having large sonic pressure.

The above-described compressive gas used in the sonic soot blower according to the invention can be heated by radiant heat from the soot blower-installed equipment such as a boiler furnace, and therefore it is not necessary for another heating source to be installed for the compressive gas. That is, since the radiant heat energy from the soot blower-installed equipment is increased by the compressive gas along with an increase in the gas temperature (t') in the soot blower-installed equipment, and the temperature (t) of the compressive gas can be raised, as has been made clear by expression (4), it becomes possible to easily increase the oscillation frequency (f).

On the other hand, a soot blower according to the above-described system (b) of the invention is based on a method of varying the oscillation frequency by changing the length of a resonance tube to change the wavelength (λ) of the frequency when columnar resonance arises in the sonic soot blower, wherein since the temperature (t) of the compressive gas is constant, the sonic velocity (C) of sonic waves oscillated by the soot blower is constant based on expression (2). Thus, the soot blower according to the above-described system (b) has an oscillation frequency varying system in which the sonic velocity (C) is constant. Therefore, although the sonic pressure lowers as the resonance system is changed in the resonance tube if the length of the resonance tube changes, the soot blower according to the above-described system (a) featured in that the oscillation frequency (f) can be changed at a high sonic pressure since the length of the resonance tube can be maintained at the best length in relation to its structure.

Also, the soot blower of the above-described system (c) of the invention is based on a method by which the length of a resonance tube is changed to change the wavelength (λ) of the frequency when carrying out columnar resonance, such that the sonic velocity is changed and the temperature (t) of a gas (compressive gas) is changed. The soot blower according to the above-described system (c) is a combination of system (a) and system (b), and is featured in that, as shown in FIG. 13, the range of operation (arrow (c)) of the oscillation frequency is wider than that in system (a) (arrow (a)) or system (b) (arrow (b)) described above.

Next, a description is given of heat transmission tubes of a boiler being a representative example of the invention in which a sonic soot blower is employed, using the heat transmission tubes as an example of members installed in soot blower-installed equipment.

First, a frequency of stationary waves is selected, which brings about increased effects of removing powdery dust such as ash adhered on the members such as heat transmission tubes, and preventing powdery dust from adhering to the above-described member(s).

A pair of sonic soot blowers is installed on the wall surface opposite to the wall of a boiler furnace. As stationary waves of sonic waves are formed in the direction of the furnace width, the sonic pressure is increased at the furnace wall side as shown in the sonic pressure distribution line 110 of FIG. 17 (*a*), and a recess in which the sonic pressure is lowered is formed in the direction of the furnace width. Gas elements greatly oscillate in the recess of the sonic pressure (see the arrow 111), wherein if there is a portion where ash adheres, on the heat transmission tubes, the adhered ash can be removed. However, all the gas elements are almost stationary at portions in which the sonic pressure is high (See FIG. 12), and the ash adhering to the heat transmission tubes in this area cannot be removed.

As the sonic waves oscillated and transmitted to the boiler furnace are stopped after stationary waves of the sonic waves are formed in the boiler furnace, no energy which forms the stationary waves is generated, and the portion which has been in a high sonic pressure will not be able to keep the high sonic pressure. The result, as shown in FIG. 17(*b*), is that gas particles oscillate (or move) from the portion of the high sonic pressure to the portion of lower sonic pressure (at this time, the sonic pressure distribution 110 until now is shown with broken lines). Therefore, the gas particles move from both sides into the recessed portion of sonic pressure, in which gas particles have greatly oscillated by now. And, the gas particles in this area are placed among the incoming gas particles, and enter a stationary state (Arrow 113). Instead, portions where gas particles have not oscillated till now greatly oscillate (Arrow 114), whereby ash is removed from the heat transmission tubes at the portions.

Thus, the scope of removal of ash can be widened by turning the sonic wave oscillation ON and OFF. However, the ash will still only be removed from a certain limited area. In addition, by repeating the ON-OFF of the sonic wave oscillation, it is possible to widen the area of intensive oscillation of gas particles in the width direction of furnace. The oscillation energy per unit time, resulting from sonic waves, can be increased by shortening the time of repetition of the above-described ON-OFF procedure. The performance of removal of ash and prevention thereof from adhering can also be improved. Further, in order to increase the performance of the removal of ash and the prevention thereof from adhering, the number of the order of resonance is changed. In other words, the the removal of ash can be intensified by using a plurality of frequencies of the stationary waves.

In addition, by finding a frequency on which a strong effect can be brought about to remove ash on the members installed in the above-described soot blower-installed equipment and to prevent them from adhering thereto, the corresponding frequency is caused to oscillate by a sonic wave oscillator with the help of mixing a gas mixture in the gas mixer. The corresponding gas mixture is then conducted to the sonic wave oscillator, wherein a method for operating a sonic soot blower, in which the operation for oscillating and stopping sonic waves is repeated, can be employed by using a sonic soot blower having the corresponding sonic wave oscillator.

At this time, if the number of times of repetition of the above-described oscillation and stopping of sonic waves is set to five or more in the period of time in which the gas temperature rises to an appointed level after the sonic waves stop (refer to FIG. 16), the above-described effect of the removal of ash and prevention thereof from adhering can be increased.

Next, a description is given of the structure of a sonic soot blower according to system (a).

The sonic soot blower according to the above-described system (a) mainly includes a sonic wave oscillator, a resonance tube and a horn, wherein the corresponding sonic wave oscillator is structured so that it oscillates sonic waves by compressed air or steam. A distinguishing feature of the present invention is that a gas mixer is provided at the upstream side of the sonic wave oscillator as a frequency regulating section, and at least two gas flow channels, which supplies gases having different temperatures from each other or gases having a narrow width of the temperature change and having different densities from each other, are connected to the above-described gas mixer.

As the gases having different temperatures from each other or gases having a narrow width of temperature change and having different densities from each other, ordinary temperature compressed air obtained by compressing the atmospheric air, heated and compressed air obtained by heating the corresponding ordinary temperature compressed air at the furnace wall portion of a boiler furnace, steam of various temperature levels and of various densities, which are obtained by the boiler, may be used.

Since the steam of various temperature levels and of various densities, which is obtained by the boiler, is less expensive than compressed air, the use of steam is more cost effective than that of compressed air.

Also, as described above, if gases of different densities are mixed, the oscillation frequency in a small width of temperature change can be varied. The most realistic way to obtain compressive gas for sonic wave oscillation is by mixing steam and air.

In addition, the resonance tube secured between the sonic wave oscillator and horn in the above-described sonic soot blower may be of a constant length. The resonance tube may also be constructed so that it is provided with a slide mechanism. This is a sonic soot blower according to the above-described system (c). A description is given of the sonic soot blower having a resonance tube provided with a slide mechanism, which is the sonic soot blower according to the above-described system (b) later. However, the sonic soot blower according to the above-described system (c) is constructed so that the above-described system (a) and system (b) are combined together.

Since, in the sonic soot blower according to system (c), a resonance tube provided with a slide mechanism as a frequency regulating section and a gas mixer, which mixes gases having different temperatures or different densities are combined, a plurality of stationary waves can be formed in a wide range in the furnace. Therefore, it is possible to find, among a wide range of frequencies, the frequency having the optimal effect in the removal of ash adhering to the members installed in the above-described soot blower-installed equipment and preventing ash from adhering thereto.

In either of the sonic soot blower according to the above-described system (a) and the sonic soot blower according to the above-described system (c), the horn thereof is covered by a heat-shielding attachment box, and the gas mixer, sonic wave oscillator and resonance tube are shielded and/or covered by a soundproof lagging, making it possible to shut heat out and/or to achieve noise proofing of the sonic soot blower.

Since the sonic wave oscillator provided with a vibrator is an accurate machine, the oscillator is thermally interrupted from a furnace by the above-described heat-shielding attachment box. In spite of this, the temperature inside the sonic wave oscillator rises due to heat transmission. Therefore, it is necessary to increase cooling capacity.

A gas of approx. 0.5 Mpa, for example, compressed air, is applied to the compressive gas inlet of the sonic wave oscillator of the sonic soot blower according to the invention, and air, whose pressure has been reduced to the atmospheric pressure, is discharged from the outlet as an exhaust gas after having driven the oscillation plate of the sonic wave oscillator. At this time, since the air at the out let of the sonic wave oscillator is expanded due to heat shut-off, the outlet of the sonic wave oscillator and the resonance tube attached to the corresponding outlet are cooled down, wherein even if the atmospheric air temperature is 30° C., their temperatures are cooled to approx. 4° C.

Thus, by utilizing the cooling effect due to heat shut-off expansion of the compressive gas at the sonic wave oscillator output, even if heat radiation occurs due to the combustion of the gas in the boiler furnace, the environmental conditions in which the drive section of the sonic wave oscillator can normally operate are maintained.

Further, where steam is used as a gas to form the sonic waves of the sonic wave oscillator, for example, steam of approx. 0.5 Mpa at 200° C. enters the sonic wave oscillator, and steam whose pressure is reduced to the atmospheric pressure level is discharged from the outlet of the sonic wave oscillator as exhaust after having driven the oscillation plate. If the gas mixer itself is in a cold state when supplying steam to the corresponding gas mixer, the steam is condensed as drain, and the drained humidity is brought into contact with the oscillation plate of the sonic wave oscillator, wherein a drain attack occurs.

If the sonic wave oscillator using steam is located in a heat-shielding attachment box internally incorporating a horn, the sonic wave oscillator may be heated by heat radiation due to a high temperature gas such as a boiler combustion gas, whereby the above-described drain attack can be prevented from occurring. Further, if the above-described sonic wave oscillator is disposed in a heat-shielding attachment box made of thick metal plates, the noise level that is emitted from the sonic wave oscillator can be reduced or eliminated.

Next, a description is given of the construction of a sonic soot blower according to the above-described system (b).

The sonic soot blower according to the above-described system (b) includes a sonic wave oscillator internally incorporating an oscillation plate performing oscillation by using a compressive gas (compressed air or steam, etc.), a resonance tube for resonating sonic waves oscillated by the corresponding sonic wave oscillator, and a horn for amplifying the sonic waves, and is featured in that it is provided with a slide mechanism for varying the length of the resonance tube as a frequency-regulating portion. With this construction, since a single sonic soot blower can form a plurality of stationary waves in a furnace, it is possible to oscillate sonic waves, in which a plurality of columnar resonance frequencies are continuously varied, in a boiler furnace.

At this time, it is recommended that the slide mechanism of the above-described resonance tube is composed of a straight internal tube disposed at the sonic wave oscillator side and an outer tube which permits the corresponding inner tube to be partially inserted thereinto and is connected to the horn. Since the horn is disposed near a high temperature part such as a boiler furnace, the above-described outer tube connected to the corresponding horn is more likely to expand than the above-described inner tube. Therefore, in order to cause the resonance tube to slide, the inner tube is disposed closer to the low temperature side than the outer tube.

Also, in the sonic soot blower according to the above-described system (b), if the heat-shielding attachment box incorporating the horn and an attachment casing internally incorporating a sonic wave oscillator and the slide mechanism of a resonance tube are covered by shielding and/or soundproof lagging, it is possible to shut off the noise and/or interrupt the heat radiation sound of the sonic soot blower.

In addition, if the straight resonance tube having the above-described slide mechanism is used, and the length of the corresponding straight tubular portion is made not more than ⅙ through 1/10 of the wavelength formed by the sonic velocity at the compressed air temperature and oscillation frequency at the outlet of the sonic wave oscillator, it is possible to securely control the frequency at the minimum stroke, wherein it has experimentally been confirmed that the sonic soot blower can be reduced in size, and the sonic wave oscillation frequency can be varied at a slight stroke.

The length of the straight tubular portion of the resonance tube is adjusted by the slide mechanism that constitutes the straight tubular portion. However, since the slide mechanism is composed of electrical devices such as a resonance tube driving motor, and accurate mechanical components such as slide mechanism parts, the range of operable temperatures is limited. In order to meet the limitation conditions, heat from the furnace is blocked by the above-described heat-shielding attachment box. However, the temperature inside the slide mechanism is bound to rise due to heat transmission. Therefore, it is necessary to intensify the cooling capacity of the slide mechanism. Compressed air that expands due to heat shut-off at the outlet of the sonic wave oscillator may be used for cooling after it has been used for the oscillation of sonic waves as in the description of the sonic soot blowers according to systems (a) and (c).

By using the cooling action brought on by heat shut-off expansion of the compressed air at the outlet of the above-described sonic wave oscillator, even if heat radiation occurs from the combustion gas of the boiler, the environmental conditions under which electrical devices such as a resonance tube driving motor can normally operate are maintained.

Also, in the slide mechanism composed of a combination of the inner tube and outer tube of the above-described resonance tube, if the inner tube is provided at the outlet side of the sonic wave oscillator, the inner tube is normally cooled with compressed air that always expands due to heat shut-off, making it possible to prevent the inner tube from expanding in the inside of the outer tube, and there is no fear that the inner tube will stick to the inside of the outer tube in the slide mechanism.

Also, a plurality of sonic wave oscillating and frequency-fixed type sonic soot blowers are prepared, which can oscillate specified columnar resonance frequencies different from each other, and the respective sonic soot blowers that can oscillate a frequency that satisfies the operating conditions of respective portions are disposed at a plurality of portions of the soot blower-installed equipment, whose operating conditions are known in advance, wherein such a structure may be employed, in which sonic waves of frequencies suited to the respective disposed portions are, respectively, oscillated.

In this case, a sonic soot blower that is able to oscillate sonic waves of specified frequencies corresponde to the gas temperature conditions of respective areas even if the gas temperature conditions in each area in the soot blower-installed equipment, may be disposed at the respective areas. For example, a pair of sonic soot blowers that are capable of oscillating sonic waves of a specified frequency are disposed at, the wall surface of portions, which are under specified gas temperature conditions, of the boiler furnace walls opposed to each other.

By using various types of sonic soot blowers according to the invention, sonic waves of the optimal specified frequencies are oscillated for a plurality of members of the soot blower-installed equipment, and it is possible to remove powdery dust such as ash, which adheres to the respective plurality of members, and to prevent future ash adherence.

For example, the gas temperature around the group 3 of heat transmission tubes in the furnace, which are disposed on the ceiling of the boiler furnace shown in FIG. 10 and consisting of suspension type heat transmission tubes, differs from that around the group 4 of heat transmission tubes, which are disposed at the rear heat transmission portion of the boiler and consists of horizontal type heat transmission tubes. Therefore, the characteristics of ash adhered to the suspension type heat transmission tubes differ from those of ash adhered to the horizontal type heat transmission tubes. In such a case, by using various types of sonic soot blower according to the invention, sonic waves of frequencies suited to the characteristics of ash that has adhered to groups 3 and 4 of the heat transmission tubes are generated, making it possible to remove the ash therefrom or to prevent the ash from adhering thereto.

If the frequencies of stationary waves suited to the characteristics of the ash that has adhered to the groups 3 and 4 of the heat transmission tubes are known, sonic soot blowers that are not provided with any frequency regulating part and which can generate specified sonic waves suited to the respective groups 3 and 4 of heat transmission tubes, may be, respectively, installed at the installation portions of groups 3 and 4 of the heat transmission tubes. In this case, it is necessary to prepare a number of sonic soot blowers that can oscillate sonic waves of specified frequencies that are different from each other.

Further, the following method was used to confirm the frequencies of stationary waves of sonic waves when operating a sonic soot blower being the second object of the invention.

Gas temperature meters are provided at the outlet and inlet of the soot blower-installed equipment (for example, a boiler), in which members (for example, heat transmission tubes of a boiler, etc.) are installed and through which a gas flows, and a dust monitor that measures the dust density of the gas is installed at the above-described outlet. Further, a sonic soot blower according to the invention is installed in the soot blower-installed equipment. And, sonic waves are oscillated in the soot blower-installed equipment by a sonic soot blower while varying the frequencies thereof. By checking the states, in which the dust density is increased or the gas temperature is lowered, by means of the dust monitor or the gas temperature meters, it is possible to find a frequency having a strong effect with respect to the removal of powdery dust that has adhered to the above-described members on prevention thereof from adhering thereto.

The sonic soot blower used at this time may be provided with the above-described frequency-regulating portion or a plurality of frequency-fixed type sonic soot blowers with different frequencies.

If a frequency is found that has a strong effect with respect to removal of powdery dust that has adhered to the members installed in the above-described soot blower-installed equipment or a frequency having a strong effect with respect to prevention thereof from adhering thereto, it is possible to employ a method for operating sonic soot blowers that repeat the oscillation and stopping of sonic waves by using sonic soot blowers that oscillate the corresponding frequencies.

Further, in the case where sonic soot blowers according to the invention are installed in a large output coal-burning boiler, it is necessary to effectively cool the sonic soot blowers. That is, it is necessary to effectively cool the sonic soot blowers without increasing the amount of cooling air used and without producing a disturbance in the control of the oxygen concentration in the boiler. Accordingly, it is necessary that the following conditions be satisfied.

(1) A gas constituent that does not exert any disturbance to the control of oxygen concentration in the boiler is used as a coolant medium.

(2) With respect to the material of the casing in which a sonic wave oscillator and horn are incorporated, a cooling medium of a gas temperature is used, which can sufficiently maintain strength.

The above-described conditions are achieved by using, if the soot blower-installed equipment is a boiler, (1) GRF (Gas Re-circulation Fan) outlet exhaust gas having a low oxygen concentration, (2) an exhaust gas whose temperature is lowered after the outlet exhaust gas has been used to preheat air for boiler combustion, or (3) compressed air.

The third object of the invention is to provide sonic soot blowers (any one of a frequency-variable type or a frequency-fixed type may be acceptable), each of which will include a sonic wave oscillator, a resonance tube to resonate sonic waves oscillated by the sonic wave oscillator, and a horn to amplify the sonic waves, installed in soot blower-installed equipment (for example, a boiler, etc.), in which members (such as heat transmission tubes) are secured, wherein each of the sonic soot blower further includes a heat-shielding attachment box having at least the horn, and a gas flow channel that uses a gas (waste combustion gas, etc.,) obtained at the outlet of the installation portion of the above-described members or compressed air as a cooling gas in the above-described heat-shielding attachment box.

Also, heat exchangers that cool the gas (waste combustion gas, etc.) obtained at the outlet at the soot blower-installed equipment, in which members such as heat transmission tubes are installed, may be provided in the above-described gas flow channel as necessary.

In the case where the soot blower-installed equipment is a boiler, if a gas such as the boiler outlet waste gas and GRF outlet waste gas, etc., is used as a cooling gas in the heat-shielding attachment box, it is possible to prevent a disturbance in the control of the oxygen concentration in the boiler. In addition, since the above-described cooling gas is in almost the same temperature range as that of a fluid, that is, steam flowing inside the furnace wall in the vicinity of the furnace wall opening of the boiler furnace in which the sonic soot blowers are installed, unnecessary thermal stress is not allowed to occur at the wall component members of the furnace if the above-described cooling gas is discharged in the heat-shielding attachment boxes, and the above-described cooling gas cools the heat-shielding attachment boxes, wherein it is possible to prevent powdery dust such as ash from adhering to the boiler opening.

Where the frequency-regulating portion of the sonic soot blower is a resonance tube equipped with a slide mechanism, a part of the resonance tube is made of a U-shaped tube. The U-shaped tube portion and electrical devices such as a resonance tube driving motor are disposed outside the heat-shielding attachment box. The accurately machined slide mechanism comprising the resonance tube and the above-described motor, etc., are cooled by the atmospheric air outside the heat-shielding attachment box, and the temperature thereof is prevented from becoming too high.

In addition, in a case where the above-described resonance tube is composed of a combination of the inner tube of the corresponding U-shaped tube and an outer tube slidable on the outer circumferential surface of the corresponding inner tube (See FIG. 7), if the U-shaped inner tube is constructed to be slidable, the length of the resonance tube can be adjusted to modulate the frequency. Further, it is no longer necessary to move the sonic wave oscillator connected to the outer tube and having some weight, and it is possible to reduce the size of the slide mechanism and to lighten its weight.

The following measures are taken so that gas in the soot blower-installed equipment is prevented from entering the sonic soot blowers, which is the fourth object of the invention.

A frequency-variable or frequency-fixed type sonic soot blowers are used. Each is provided with a heat-shielding attachment box internally incorporating 1) a horn that is installed in the opening of the wall surface of soot blower-installed equipment, and 2) a gas flow channel that conducts a gas or atmospheric air, which is expelled from the outlet of the gas flowing through the soot blower-installed equipment into the above-described heat-shielding attachment box. This gas or atmospheric air is used as a cooling gas in the corresponding heat-shielding attachment box, wherein a gas inflow preventing damper is provided to opened and close in the opening at the soot blower-installed equipment side of the heat-shielding attachment box internally incorporating the above-described horn.

When carrying out maintenance work of sonic soot blowers by using the above-described frequency-variable or frequency-fixed type sonic soot blower, the above-described gas inflow preventing dampers are closed to interrupt the sonic soot blowers from the inside of the soot blower-installed equipment, whereby a dirty gas in the soot blower-installed equipment is not permitted to invade the sonic soot blowers.

For the above-described frequency-variable type sonic soot blowers, the sonic soot blower constructed as described below may be used, wherein: 1) a heat-shielding attachment box internally incorporating a horn and a sonic wave oscillator attaching casing provided with a gas mixer and/or a resonance tube equipped with a slide mechanism and internally incorporating a frequency regulating section are provided adjacent to each other; 2) a communication section that communicates with the atmospheric air via a check valve is provided on the wall surface, in contact with the atmospheric air, of the above-described sonic wave oscillator attaching casing; 3) a communication section that causes both the box and casing to communicate with each other via a check valve is provided at the boundary part between the above-described heat-shielding attachment box and the above-described sonic wave oscillator attaching casing; and 4) a compressive gas supply channel equipped with a needle valve is provided in the sonic wave oscillator attachment casing.

When the frequency-variable type sonic soot blowers are used, the sonic soot blower may be constructed such that: 1) a drive section of the frequency-regulating section is disposed further at the outside of the sonic wave oscillator attaching casing that internally incorporates the above-described frequency-regulating section; 2) a drive section attaching casing is provided so as to cover the corresponding drive section; 3) a communication section that causes both the casings to communicate with each other via a check valve is provided at the boundary between the corresponding drive attaching casing and the above-described sonic wave oscillator attaching casing; and 4) a communication section that communicates with the atmospheric air via a check valve is provided on the wall surface, in contact with the atmospheric air, of the above-described drive section attaching casing.

Where the sonic soot blowers constructed as described above and further equipped with a frequency-regulating section are normally operated in a soot blower-installed equipment whose inner pressure is lower than the atmospheric air in normal operation, the atmospheric air or a gas flowing through the soot blower-installed equipment flows in the sonic soot blowers via 1) the respective communication sections of the drive section attaching casings of the frequency-regulating section, and 2) the sonic wave oscillator attaching casings and heat-shielding attachment boxes, whereby in-furnace gas is prevented from entering the sonic soot blowers. Simultaneously, the frequency regulating section, the drive section of the frequency-regulating section, the sonic oscillator, the resonance tube and the horn of each of the sonic soot blower are cooled with the atmospheric air or the gas flowing through the soot blower-installed equipment passing through the above-described respective communication sections.

In addition, where the sonic soot blower equipped with the above-described frequency-regulating section is used in a soot blower-installed equipment whose internal pressure is lower than the atmospheric air, a compressed gas in normal operation is supplied from the compressive gas supply channel equipped with a needle valve into the sonic oscillator attaching casing when stopping the operation of the soot blower-installed equipment, and the gas inflow preventing damper secured in the opening of the heat-shielding attachment box internally incorporating the horn, located at the soot blower-installed equipment side, is closed when carrying out maintenance work of the above-described sonic soot blower, whereby the sonic soot blower and the inside of the soot blower-installed equipment are separated from each other.

The fifth object of the invention is achieved as follows.

A description is given of the case where the soot blower-installed equipment is a denitration apparatus in which a plurality of denitration catalyst layers are disposed in the direction of the gas flow.

If sonic soot blowers, in which the sonic pressure becomes higher and higher in the denitration catalyst layers from the upstream stage to the downstream stage in the gas flow through a plurality of denitration layers in the denitration apparatus, are disposed in the vicinity of the respective denitration catalyst layers, the effect that prevents ash from adhering is improved.

Also, since an area where a gas flow detours is liable to occur in the vicinity of portions where the gas drift of the denitration catalyst layer at the extremely upstream stage are remarkable in a gas flow in a plurality of denitration catalyst layers of the denitration apparatus, it is possible to effectively prevent ash from adhering if the sonic soot blowers are disposed in the vicinity of the portion where the gas drift are remarkable.

BEST MODE FOR CARRYING OUT THE INVENTION

A description is given of the embodiments of the invention with reference to the accompanying drawings, taking a boiler as an example.

Figure 10:
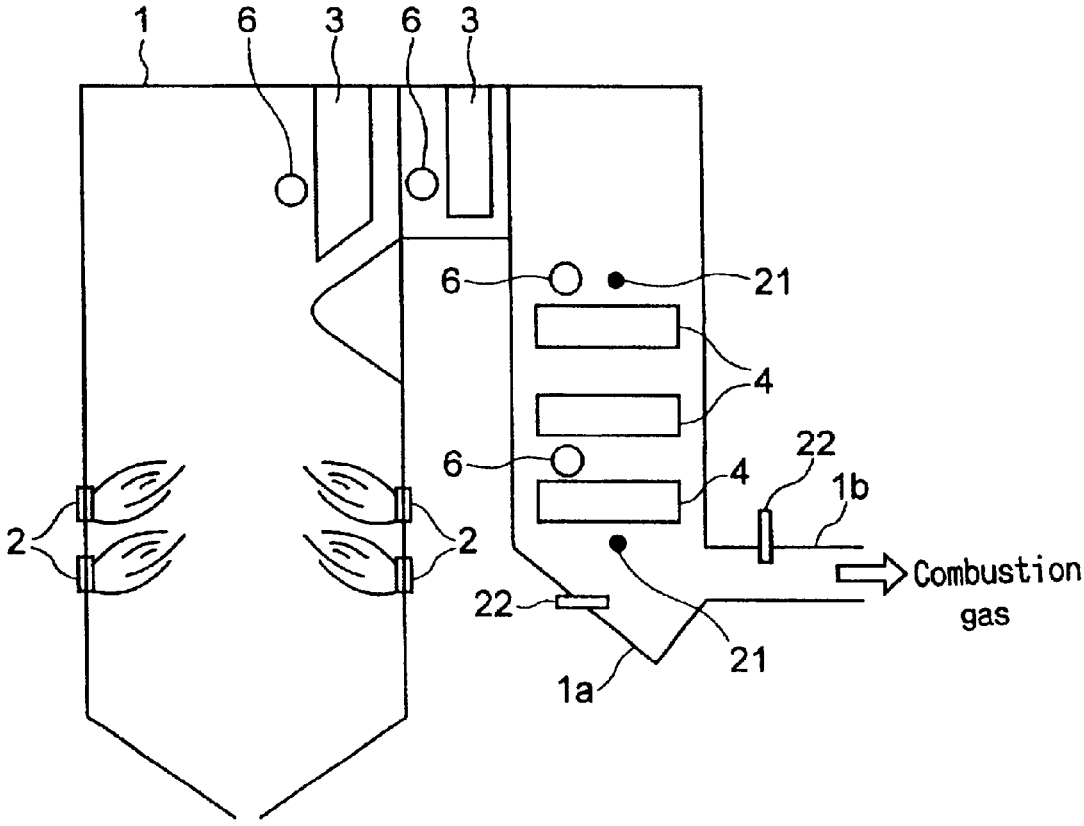
FIG. 10 is a view showing the disposed position of a sonic soot blower in a boiler according to a mode that becomes the invention.

FIG. 10 is a general sketch of the boiler, in which a burner 2 is disposed in the boiler furnace 1, a group 3 of suspension type heat transmission tubes such as a superheater, reheater, etc., are installed on the ceiling of the boiler furnace 1, and a group 4 of horizontal type heat transmission tubes such as a superheater, reheater and economizer, etc., are disposed on the rear heat transmission section of the boiler furnace 1. And, a plurality of sonic soot blowers 6 are installed on the furnace walls in the vicinity of the group 3 of suspension type heat transmission tubes and group 4 of horizontal type heat transmission tubes in the boiler furnace 1.

Figure 1:
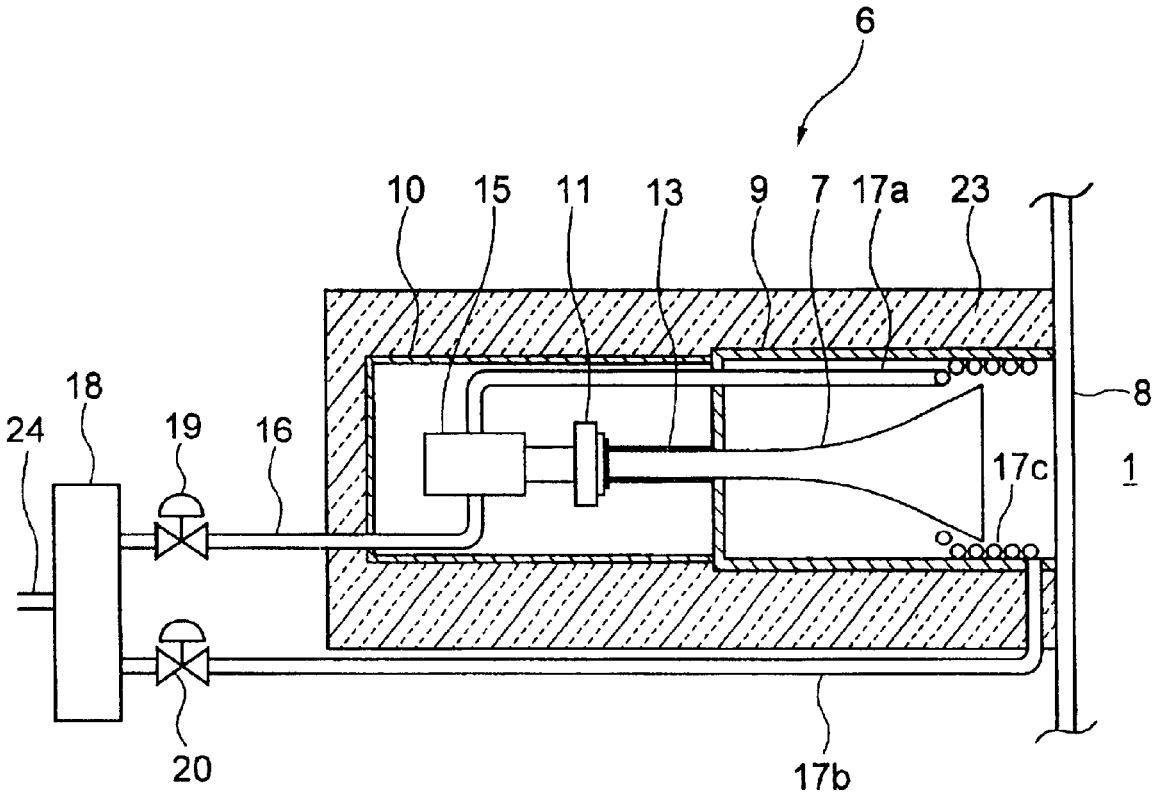
FIG. 1 shows the construction of a sonic soot blower in a boiler according to an embodiment of the invention.
Figure 2:
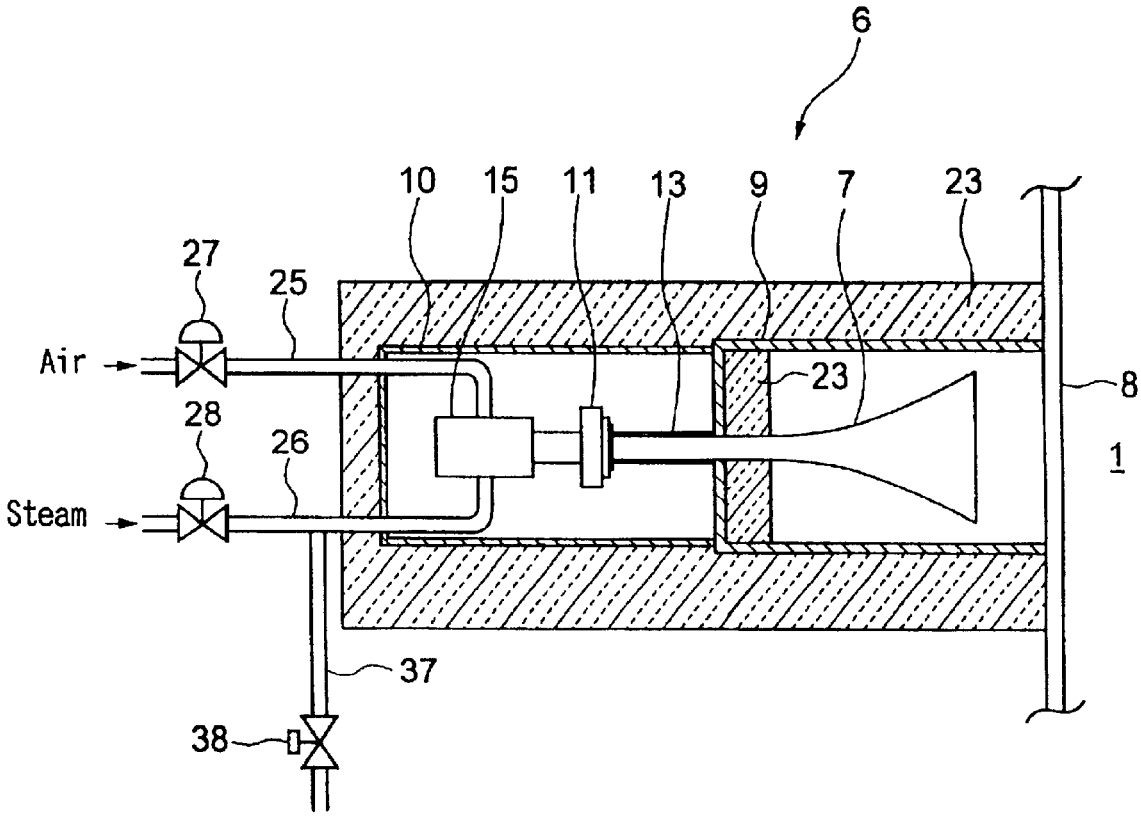
FIG. 2 is a view showing the construction of a sonic soot blower in a boiler according to another embodiment of the invention.
Figure 3:
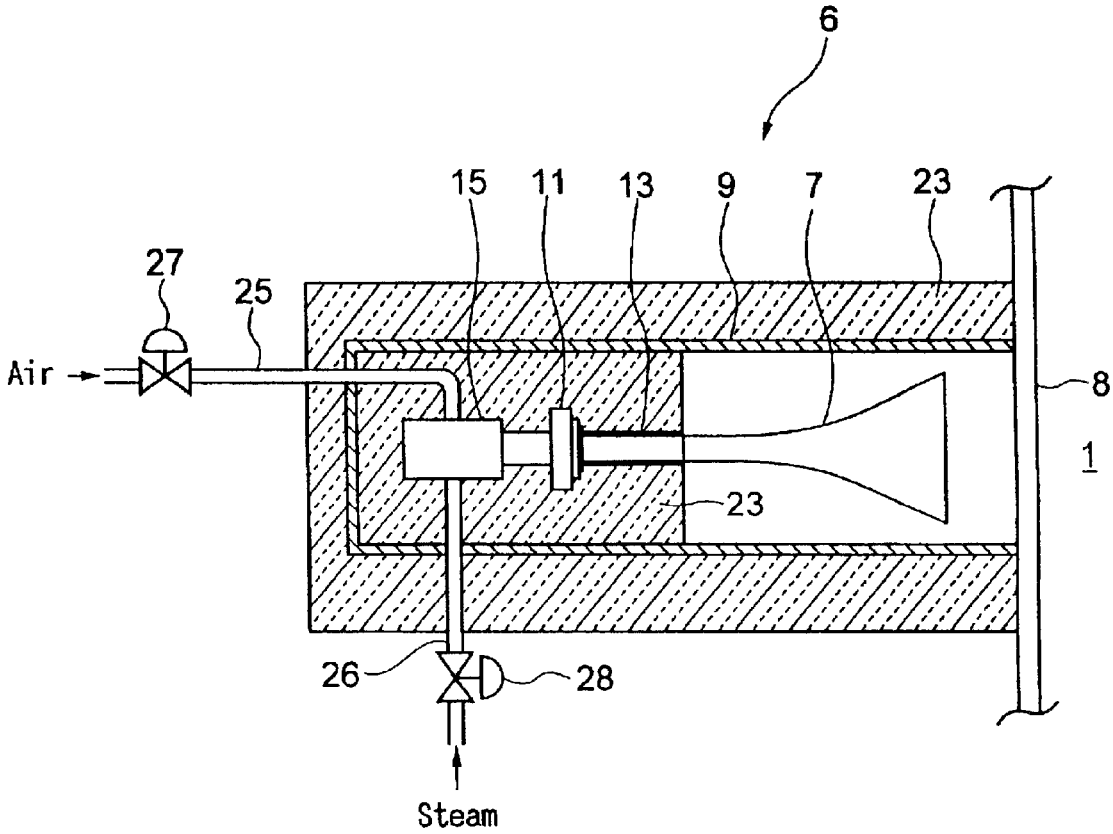
FIG. 3 is a view showing the construction of a sonic soot blower in a boiler according to still another embodiment of the invention.

A description is given of embodiments of the sonic soot blower 6 of the above-described system (a) that varies the oscillation frequency in compliance with the operation conditions of the boiler, according to the invention, with reference to FIG. 1, FIG. 2 and FIG. 3.

FIG. 1 is a general sectional view in which a sonic soot blower 6 of the compressed air drive system is installed on the wall surface of the boiler furnace 1.

A sonic soot boiler 6 is attached in the opening of a boiler furnace wall having a water wall or gauge wall 8. The sonic soot blower 6 includes a horn 7, a sonic wave oscillator 11, a resonance tube 13, and a gas mixer 15, etc.

The horn 7 is retained in a soundproof attachment box 9, which is concurrently used for heat shut-off, in order to prevent the sonic pressure emitted from the horn 7 facing the opening of the boiler furnace wall from going out of the boiler furnace 1. Also, a sonic wave oscillator 11 is connected to the horn 7 via a resonance tube 13 for regulating the frequency, and a compressive gas is supplied from the gas mixer 15 to the sonic wave oscillator 11. The sonic wave oscillator 11, resonance tube 13 and gas mixer 15 are housed in the sonic wave oscillator casing 10 secured at the rear side (the rear side with respect to the furnace 1) of the attachment box 9.

Compressed air at an ordinary temperature is supplied to the gas mixer 15 via a pipe 16, and heated compressed air is supplied thereto via a pipe 17*a*, respectively. The corresponding pipe 17*a* is connected to the ordinary temperature compressed air pipe 17*b* via an annular pipe 17*c*, wherein since the annular pipe 17*c* is installed on the inner wall of the attachment box 9 in the vicinity of the wall of the furnace 1, the compressed air in the annular pipe 17*c* is heated by a high temperature gas in the furnace 1 and is made into heated compressed air which will be supplied to the gas mixer 15. Compressed air is supplied from a pipe 24 to the pipes 16 and 17*b* through a header 18, wherein the amount of supply is regulated by flow regulators 19 and 20.

Also, soundproof lagging 23, which is concurrently used for shut-off or interruption of heat, is provided outside the heat shielding attachment box 9 and sonic wave oscillator casing 10.

Since the horn 7 of the sonic soot blower 6 and the inside of the heat-shielding attachment box 9 are subjected to a high temperature due to heat radiation from a combustion gas whose temperature is 500 through 1000° C. in the furnace 1, an adequate cooling gas is charged to lower the temperature of the accommodation section of the horn 7 to 300 through 600° C. At this temperature, there is a fear that the sonic wave oscillator 11, resonance tube 13, gas mixer 15, etc., which are accurately machined, maybe deformed and damaged. In order to prevent these components from being deformed or damaged, the sonic wave oscillator 11, resonance tube 13, and gas mixer 15 are installed in a sonic wave oscillator casing 10 separately provided outside the heat-shielding attachment box 9.

In addition, soundproof lagging 23 is provided so as to cover the attachment box 9 and sonic wave oscillator casing 10 in order to shield the horn 7, resonance tube 13 and sonic wave oscillator 11 from sound or noise and heat from the outside. Additionally, if soundproof lagging 23 is provided (see FIG. 5) in the attachment box 9, an effect that prevents the sonic wave oscillator 11, resonance tube 13 and gas mixer 15, etc., from being damaged can be further improved.

Also, since compressed air flowing from the sonic wave oscillator 11 to the horn 7 expands due to heat shut-off in the resonance tube 13, etc., the resonance tube 13, etc. can be effectively cooled, and is free from damage due to deformation thereof. Thus, it is possible to keep the internal temperature of the sonic wave oscillator casing 10 around 50° C.

Also, with the above-described construction, it becomes possible to directly attach sonic soot blowers 6 to the walls of the boiler furnace 1 in which a high temperature combustion gas flows. Further, by varying the mixing ratio of two or more gases each having a different temperature in the gas mixer 15, it becomes possible to freely regulate the oscillation frequencies during the operation of the boiler.

Sonic waves are generated by compressed air oscillating an oscillation plate disposed in the sonic wave oscillator 11. However, with respect to the sonic waves oscillated by the sonic wave oscillator 11, the wavelength of the oscillation frequency is adjusted by the resonance tube 13, and the sonic pressure thereof is amplified to 138 through 145 dB (A) by the horn 7.

The sonic soot blower 6 according to the embodiment shown in FIG. 2 is able to freely adjust the oscillation frequency by mixing compressed gases each having a different density in compliance with the operating conditions of the boiler. FIG. 2 is a general sectional view showing the state where the sonic soot blower 6 is attached to the boiler furnace wall.

In the sonic soot blower 6 shown in FIG. 2, parts which carry out the same functions to those in the sonic soot blower 6 shown in FIG. 1 are given the same reference numbers, and overlapping description thereof is omitted. In the sonic soot blower 6 shown in FIG. 2, an aspect which is different in construction from the sonic soot blower shown in FIG. 1 is that compressed air and compressed steam each having a different density are used as compressive gases that are conducted into the gas mixer 15. The compressed air is conducted from an air pipe 25, and compressed steam is conducted from a steam pipe 26, respectively. A flow regulator 27 that controls the amount of the supply of compressed air is provided at the pipe 25, and the flow regulator 28 that controls the amount of the supply of compressed steam is provided at the pipe 26, respectively. Also, a drain branching pipe 37 is connected to the steam pipe 26.

The steam temperature that drives the sonic wave oscillator 11 is approx. 200° C. when starting the sonic soot blower 6. However, if the pipes 25 and 26, and the gas mixer 15 are in a cold state, it is necessary to discharge drain outside the system by opening a drain valve 38 which is installed at the drain branching pipe 37. If a warm-up operation is sufficiently performed, the gas body in the sonic wave soot blower 6 system can be dried.

FIG. 3 shows a sonic soot blower 6 constructed so that, where the corresponding gas mixer 15 is in a cold state when supplying steam to the gas mixer 15 for sonic wave oscillation, the steam is prevented from condensing, and a drain attack is also prevented from occurring at the oscillation plate of the sonic wave oscillator 11. FIG. 3 is a general sectional view thereof in the case where a sonic soot blower 6 using compressed steam and compressed air is attached on the boiler furnace wall.

In the sonic soot blower 6 shown in FIG. 3, parts which carry out the same function as those of the sonic soot blower 6 shown in FIG. 2 are given the same reference numbers, and overlapping description thereof is omitted. In the sonic soot blower 6 shown in FIG. 3, parts which are different from those of the sonic soot blower 6 shown in FIG. 2 reside in that a gas mixer 15, sonic wave oscillator 11 and resonance tube 13 are disposed in the heat shielding attachment box 9 internally incorporating the horn 7.

By disposing the gas mixer 15, sonic wave oscillator 11 and resonance tube 13 in the heat shielding attachment box 9, the gas mixer 15, sonic wave oscillator 11 and resonance tube 13 are heated by heat radiation due to a high temperature gas such as a boiler combustion gas, etc., it is possible to prevent the drain attack of steam from occurring. Also, by wrapping the gas mixer 15, sonic wave oscillator 11 and resonance tube 13 with soundproof lagging 23 having sound shut-off and heat shut-off features, the drain attack of steam can also be prevented, and it is possible to prevent noise, which may come out of the sonic wave oscillator 11, from leaking outside.

A description is given of the embodiment of the sonic soot blower 6, which includes a resonance tube equipped with a slide mechanism of the above-described system (b) with reference to FIG. 4, FIG. 5, FIG. 6 and FIG. 7.

Figure 4:
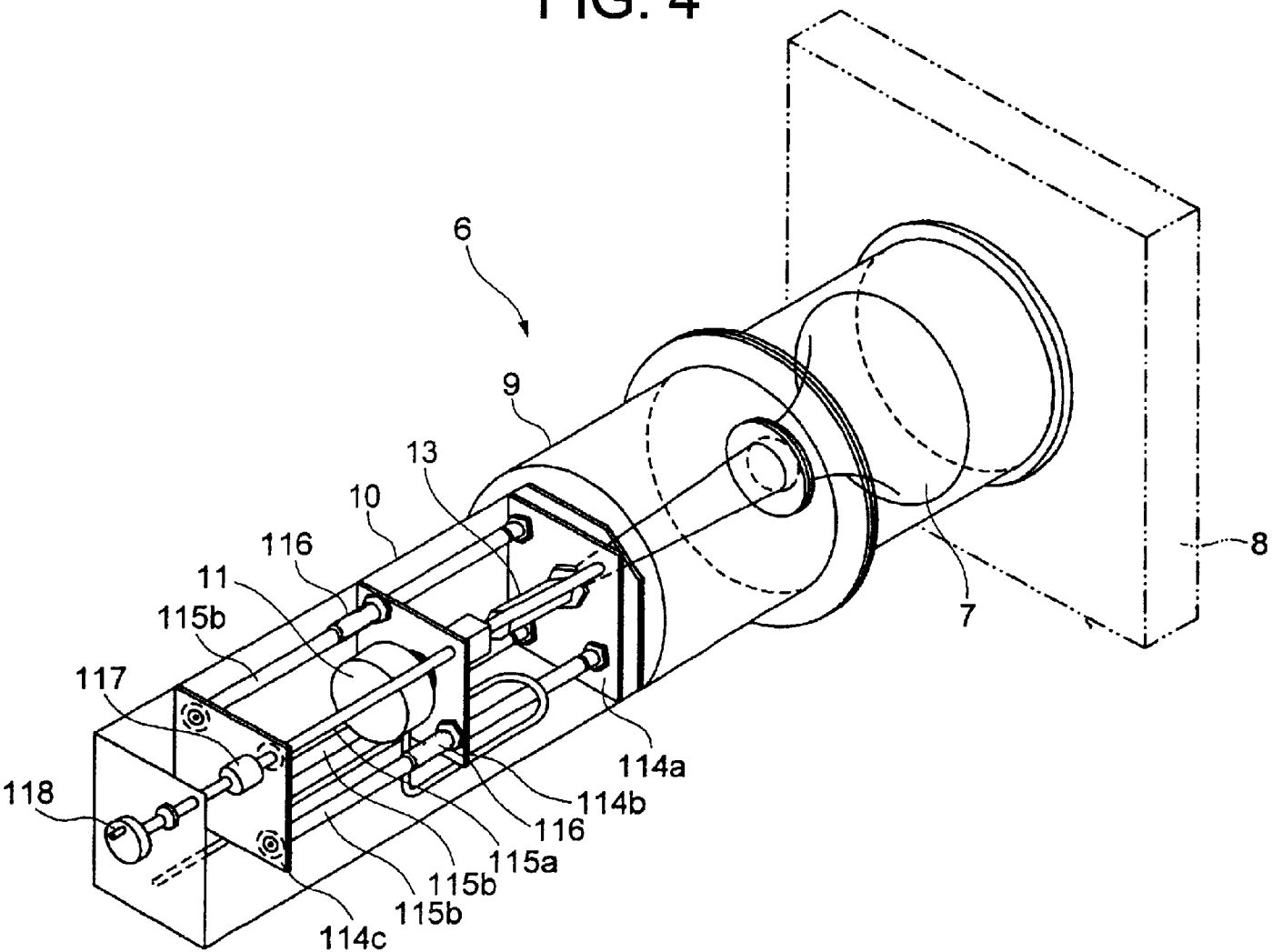
FIG. 4 is a view showing the construction of a sonic soot blower in a boiler according to the embodiment of the invention.
Figure 5:
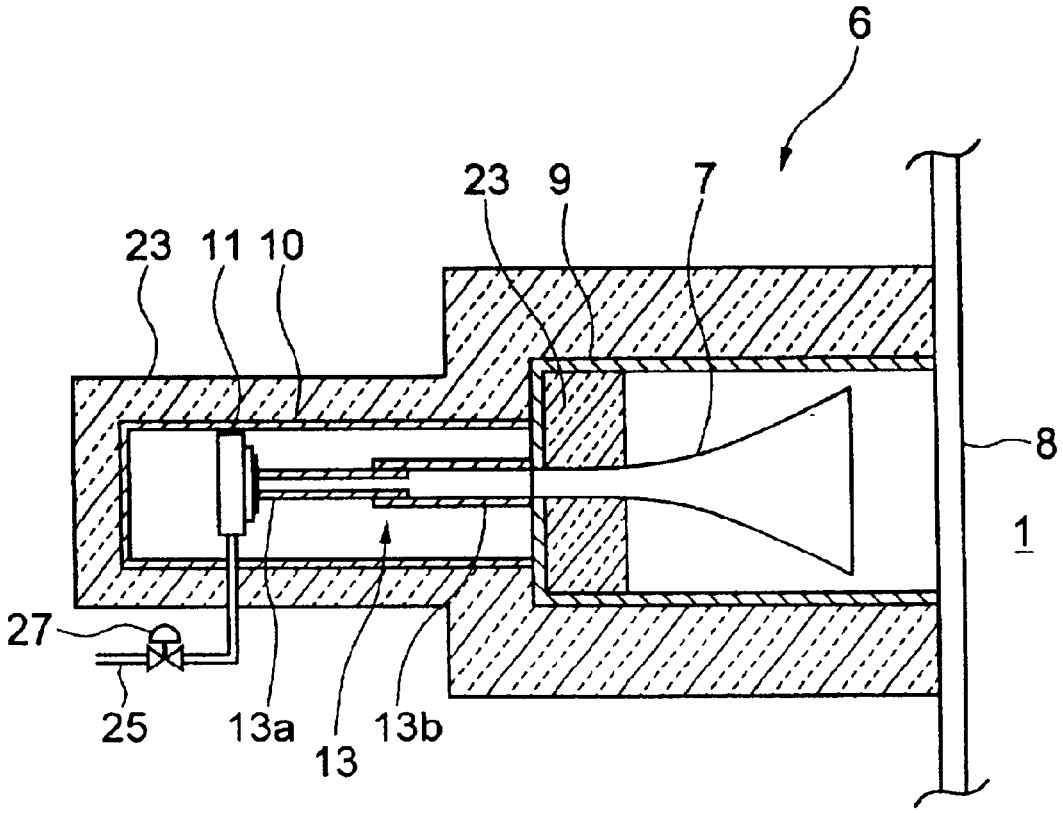
FIG. 5 is a view showing the construction of a sonic soot blower in a boiler according to the embodiment of the invention.
Figure 6:
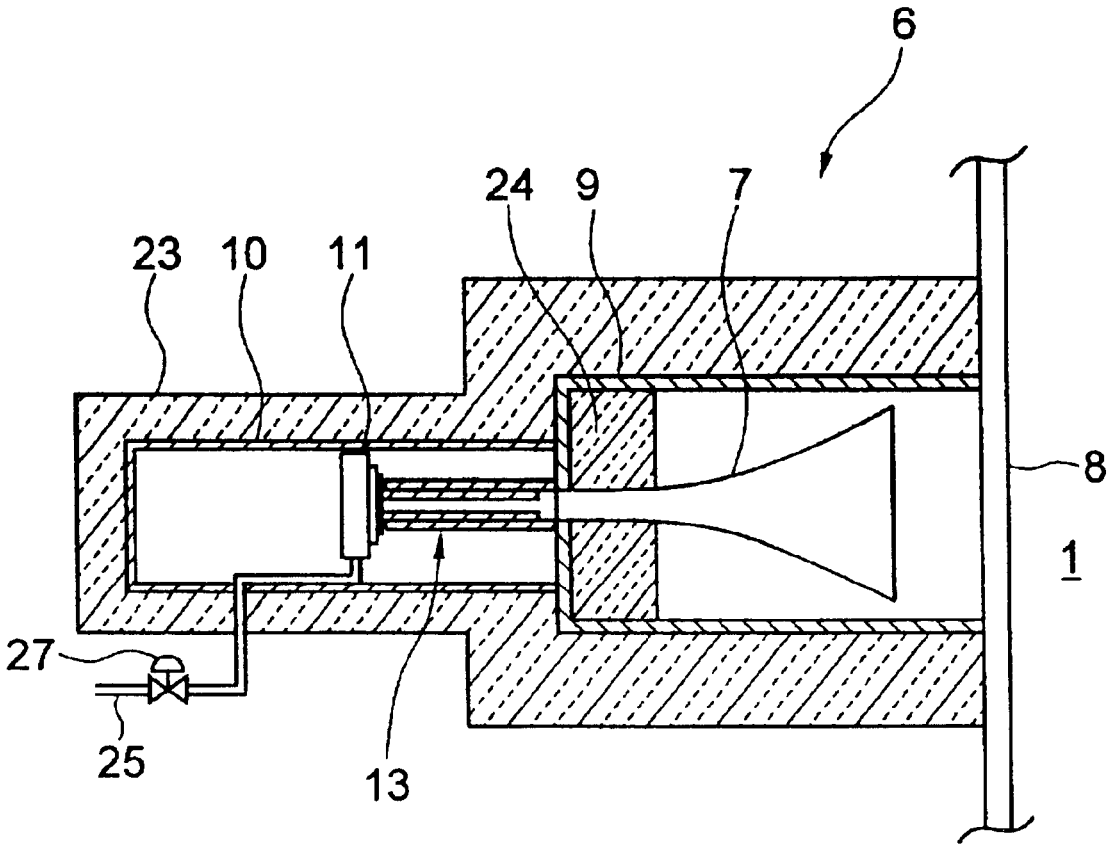
FIG. 6 is a view of the slide mechanism of the sonic wave oscillator being made short in order to regulate the frequency of the sonic soot blower shown in FIG. 5.
Figure 7:
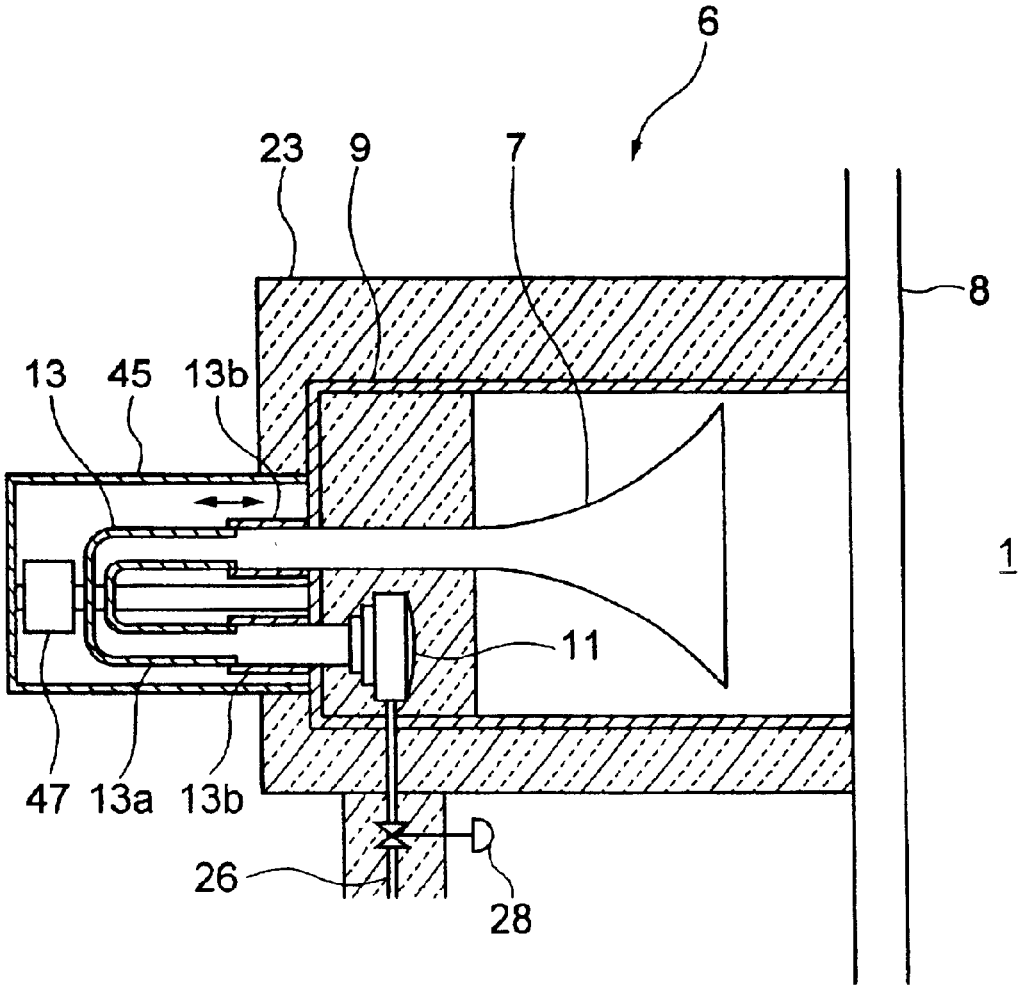
FIG. 7 is a view showing the construction of a sonic soot blower in a boiler according to the embodiment of the invention.

FIG. 4 is a perspective view in the case where a sonic soot blower 6 according to the compressed air drive system is attached to the boiler furnace wall. FIG. 5 is a general sectional view in the case where a sonic soot blower 6 according to the compressed air drive system is attached to the boiler furnace wall. Further, FIG. 6 is a general sectional view in the case where the length of the resonance tube 13 of the sonic soot blower 6 shown in FIG. 5 is changed, and FIG. 7 is a general sectional view in the case where a sonic soot blower 6 according to the compressed steam drive system is attached to the boiler furnace wall.

In the sonic soot blower 6, a sonic wave oscillator 11 having a resonance tube 13 equipped with a slide mechanism and a horn 7 are disposed in a heat-shielding attachment box 9 which is concurrently provided with a soundproof feature. Also, soundproof lagging 23 that shuts off or interrupts heat is provided outside the heat-shielding attachment box 9 and the sonic wave oscillator 11. The resonance tube 13 includes an inner tube 13*a* and an outer tube 13*b*, wherein the inner tube 13 a slides inside the outer tube 13*b*. Compressed air is supplied from the compressed air pipe 25 to the sonic wave oscillator 11, and the compressed air pipe 25 is provided with a flow-regulating valve 27.

Since the horn 7 is disposed in the vicinity of the high temperature portion inside the boiler furnace 1, the portion of the resonance tube 13, which is connected to the horn 7, has a larger thermal expansion ratio than the other portions of the resonance tube 13. Therefore, the resonance tube part, which is connected to the horn 7, is made into the outer tube 13*b*, and by disposing the inner tube 13*a* at a lower temperature side than the outer tube 13*b*, the resonance tube 13 is structured so that it can slide.

In addition, FIG. 4 shows a mechanism for sliding the resonance tube 13. Rod supporting plates 114*a*, 114*b* and 114*c* for sliding the resonance tube 13 are disposed in parallel to each other at the forward side (being referred to as the furnace 1 side), central part and rearward side (being referred to as the opposite side of the furnace 1) inside the sonic wave oscillator casing 10 in which the sonic oscillator 11 is disposed, respectively. The end parts of three rods 115*b* used for sliding the resonance tube 13 are fixed at the three of the four corners of the rod supporting plates 114*a* and 114*c*, and these rods 115*b* are constructed so that they can pass through the central rod supporting plate 114*b* and slide in cylindrical bodies 116 supported by the corresponding supporting plate 114*b*. Also, the other rod 115*a* is a threaded rod and is supported at the remaining corner of the supporting plates 114*a* and 114*c* so that it freely rotates. The rod 115*a* is screwed in a female-threaded part secured at the supporting plate 114*b*. Furthermore, a motor 117 is connected to the rear end part of the rod 115*a*. Also, the central rod supporting plate 114*b* is composed to be integrated with the sonic wave oscillator 11 and the inner tube 13*a* of the resonance tube 13.

Therefore, if the rod 115*a* rotates by drive of the motor 117, the central rod supporting plate 114*b* moves forward and rearward, wherein the inner tube 13*a* of the resonance tube 13 integrated with the rod supporting plate 114*b* accordingly moves to change the length of the resonance tube 13.

In addition, a manual handle 118 is provided at a still further rearward position from the motor-connected part of the rod 115*a*. By turning the handle 118, it is possible to manually change the length of the resonance tube 13.

Since the horn 7 of the sonic wave soot blower 6 and the inside of the heat-shielding attachment box 9 thereof are subject to a high temperature due to heat radiation from the combustion gas of a temperature (500 to 1000° C.) of the boiler furnace 1, an adequate cooling gas is charged thereinto to reduce the temperature of the disposed part of the horn 7 to 300 to 600° C. The sonic wave oscillator 11, resonance tube 13, motor 117, etc., which are accurately machined, may be deformed and damaged. To prevent this, the sonic wave oscillator 11, resonance tube 13, and motor 117 are installed in the sonic wave oscillator casing 10 which is separately installed outside the heat-shielding attachment box 9.

Further, soundproof lagging 23 is provided so as to cover the attachment box 9 and the sonic wave oscillator part 11 in order to prevent the horn 7, resonance tube 13 and sonic wave oscillator 11 from being influenced by sound or noise and heat from the outside. Also, soundproof lagging 23 is provided in the attachment box 9 internally incorporating the horn 7, whereby the sonic wave oscillator 11, resonance tube 13, and motor 117, etc., maybe prevented from becoming deformed and damaged. Since the compressed air expands due to the shutting-off of heat in the resonance tube 13 when oscillating sonic waves coming from the sonic wave oscillator 11, the resonance tube 13, etc., can be effectively cooled, and is made free from any deformation and damage. Thus, it is possible to keep the inside of the sonic wave oscillator casing 10 at around 50° C.

In addition, by the above-described construction, it becomes possible to attach the sonic soot blowers 6 directly to the furnace walls of the boiler furnace 1 in which a high temperature combustion gas flows. Furthermore, it is possible to freely vary the oscillation frequency during the operation of the boiler.

Sonic waves are oscillated by the sonic wave oscillator 11, the wavelength of the oscillation frequency is adjusted by the resonance tube 13 whose length can be varied by the motor 117, and the sonic pressure is amplified to 138 through 145 dB (A) by the horn 7. By setting the sliding length of the resonance tube 13 to not more than 1/6 through 1/10 of the wavelength, it was confirmed that the frequency control could be securely carried out with the minimum stroke.

The sonic soot blower shown in FIG. 7 is of a steam-drive type, and a sonic oscillator 11 of such a system that the oscillation plate is driven by steam supplied from the steam pipe 26 that is connected to the horn 7 via a U-shaped resonance tube 13. The steam pipe 26 is connected to the sonic wave oscillator 11, wherein the sonic waves are oscillated by steam pressure. The resonance tube 13 includes a U-shaped inner tube 13*a* and a pair of straight outer tubes 13*b* and 13*b*, wherein the inner tube 13*a* is structured so that it can slide in the straight outer tubes 13*b* and 13*b*.

The sonic soot blower 6 shown in FIG. 7 is constructed so that the horn 7 thereof is disposed in the vicinity of the high temperature part of the boiler furnace 1 as in the sonic soot blower 6 shown in FIG. 5, wherein since the outer tubes 13*b* connected to the horn 7 has a larger expansion ratio than the inner tube 13*a*, it is necessary that the inner tube 13*a* is located at an even lower temperature side than the outer tubes 13*b*, in order to cause the resonance tube 13 to slide.

The sonic wave oscillator 11 is disposed in the heat-shielding attachment box 9, and the resonance tube 13 is installed in a slide casing 45 provided outside the attachment box 9. Soundproof lagging 23, which concurrently has the function of shutting-off or interrupting heat, is provided at the outside of the heat-shielding attachment box 9 and sonic wave oscillator 11. The soundproof lagging 23 prevents sonic waves, which are generated by the horn 7 and sonic wave oscillator 11, from going outside the furnace, and concurrently another effect of functioning to keep the temperature of steam in the sonic wave oscillator 11. However, the casing 45 that accommodates the resonance tube 13 is not covered by the soundproof lagging 23, and is located so that it is cooled by the atmospheric air.

Although the horn 7 and the inside of the heat-shielding attachment box 9 are subjected to a high temperature due to heat radiation from the combustion gas temperature (500 through 1000° C.), the temperature of steam which drives the sonic wave oscillator 11 becomes approx. 200° C. Therefore, the resonance tube 13 and the slide drive motor 47, etc., of the inner tube 13*a*, which are accurately machined, are disposed so as to be directly cooled by the atmospheric air, whereby they are prevented from being deformed or damaged.

Sonic waves are generated by the sonic wave oscillator 11, and the length of the resonance tube 13 is adjusted by the motor 47 so that it becomes ⅙ through 1/10 of the wavelength of the oscillation frequency.

As described above, by employing the structure of the sonic soot blower 6 shown in FIG. 7, it becomes possible to attach the sonic soot blower 6, in which steam is directly used as a compressive gas, to the boiler furnace 1 wall in which a high temperature combustion gas flows. Further, it is possible to freely adjust the oscillation frequency.

Figure 11:
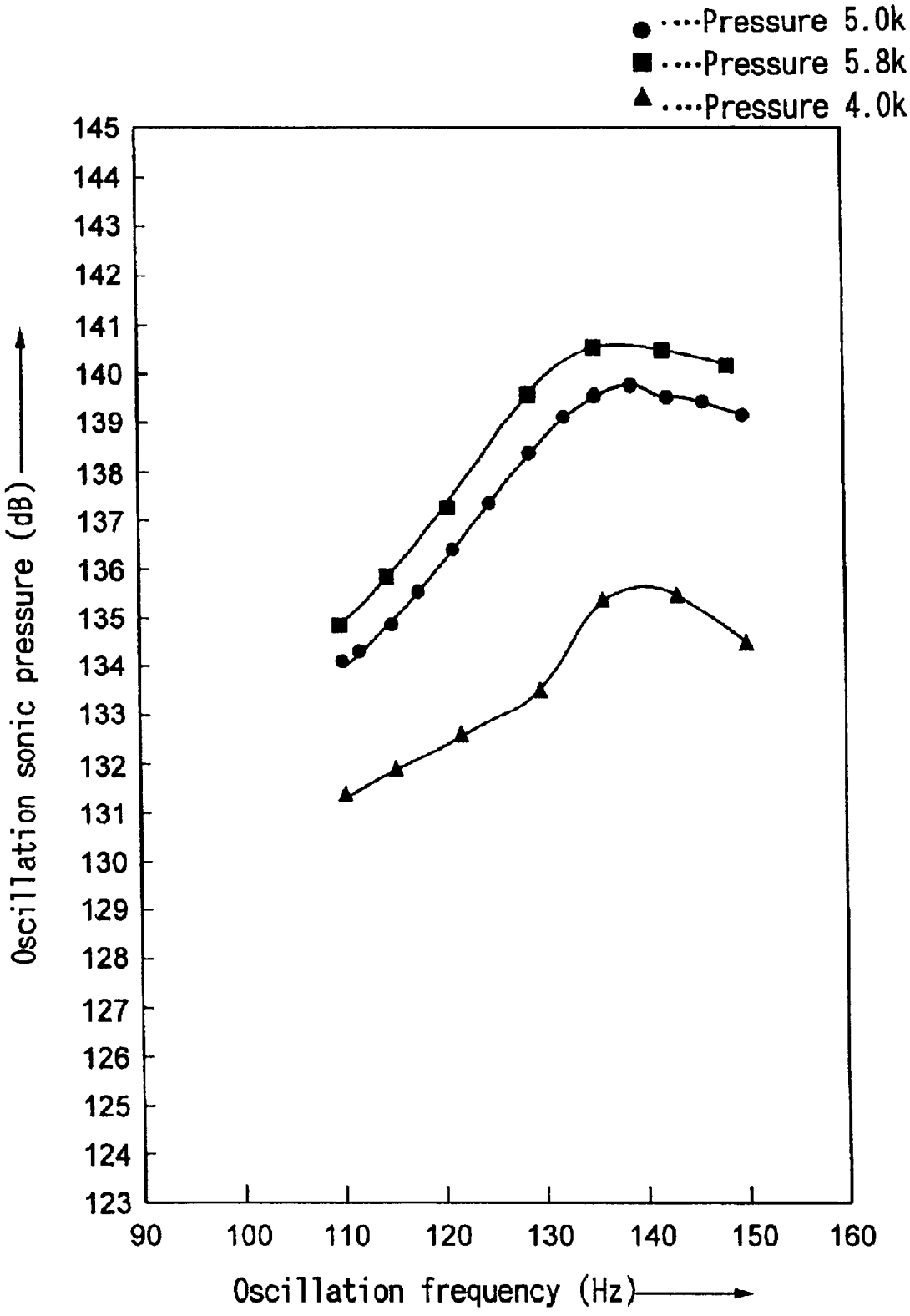
FIG. 11 is a view showing the relationship between the pressure of a compressive gas and the sonic pressure oscillated from a sonic soot blower.

FIG. 11 shows the relationship between the sonic waves, which generates various levels (4.0 k, 5.0 k and 5.8 k) of pressure of the compressive gas, and the oscillation frequencies. Based on the relationship shown in FIG. 11, if the pressure of the compressive gas is increased, the sonic pressure increases along with the respective frequencies.

Therefore, it is necessary to grasp an adequate relationship among the pressure of a compressive gas, oscillation sonic pressure, and oscillation frequency.

Generally, in the sonic soot blower 6, the size of the resonance tube 13 and that of the horn 7 are designed and produced so that the oscillation sonic waves of the sonic wave oscillator 11 becomes the maximum sonic pressure by the resonance tube 13 and horn 7. Therefore, even if the frequency of the sonic waves is changed when the length of the resonance tube 13 of the sonic soot blower 6, which controls the frequency of the oscillating sonic waves by changing the mixing ratio of two or more types of compressive gases each having a different temperature or density, does not change, the sonic pressure characteristics thereof dot not change. However, in the sonic soot blower 6 that varies the length of the resonance tube 13, the length of the resonance tube 13 is deviated from the length at which the sonic pressure becomes the maximum value, the sonic pressure thus obtained will be lower than the above-described sonic pressure.

Figure 12:
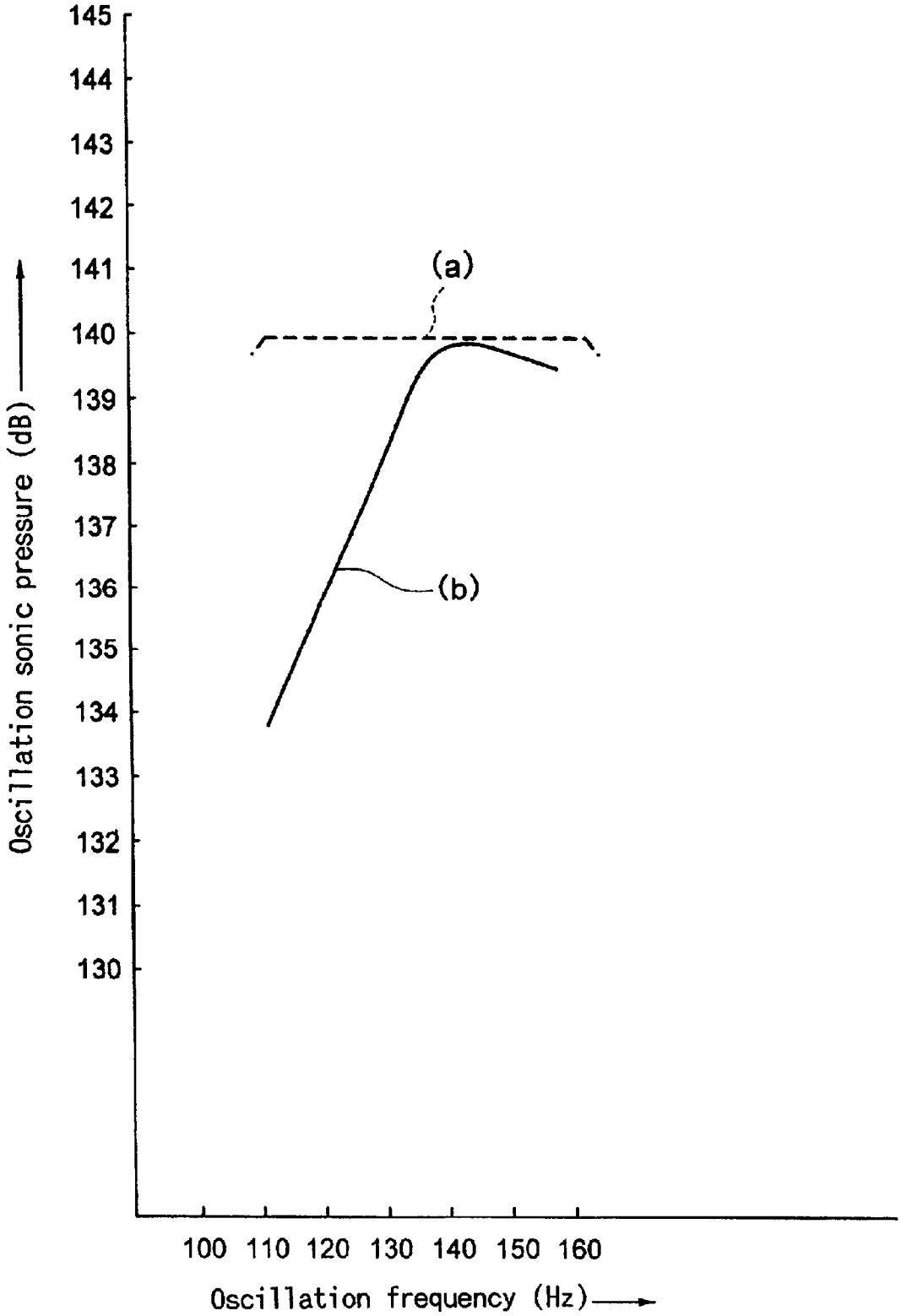
FIG. 12 shows the characteristics of sonic pressure of a sonic soot blower, in which the sonic velocity of sonic waves oscillated by varying the bending ratio of a compressive gas is controlled, and the characteristics of sonic pressure of a sonic soot blower incorporating a slide mechanism, which varies the length of a resonance tube, between the sonic wave oscillator and horn.

In FIG. 12, the sonic pressure characteristics with respect to the oscillation frequencies of the sonic soot blower 6 (the sonic soot blower according to system (a) of the invention) that controls the frequency of the sonic waves oscillated by varying the mixing ratio of compressive gases are shown by a dotted line, and sonic pressure characteristics with respect to the oscillation frequency of the sonic soot blower 6 (the sonic soot blower according to system (b) of the invention) that controls the frequency of sonic waves oscillated by only the slide mechanism of the resonance tube 13, which varies the length, disposed between the sonic wave oscillator 11 and the horn 7 is shown by a solid line.

As shown in FIG. 12, if the sonic pressure of sonic waves is controlled only by the slide mechanism of the resonance tube 13, the sonic pressure is decreased as the oscillation frequency is reduced. However, as in the sonic soot blowers 6 shown in FIG. 1 through FIG. 3 and FIG. 8, if the sonic soot blower 6 is used that includes a construction by which the mixing ratio of compressive gases can be varied, there is an advantage in that even if the oscillation frequency is reduced, the sonic pressure does not decrease.

Figure 8:
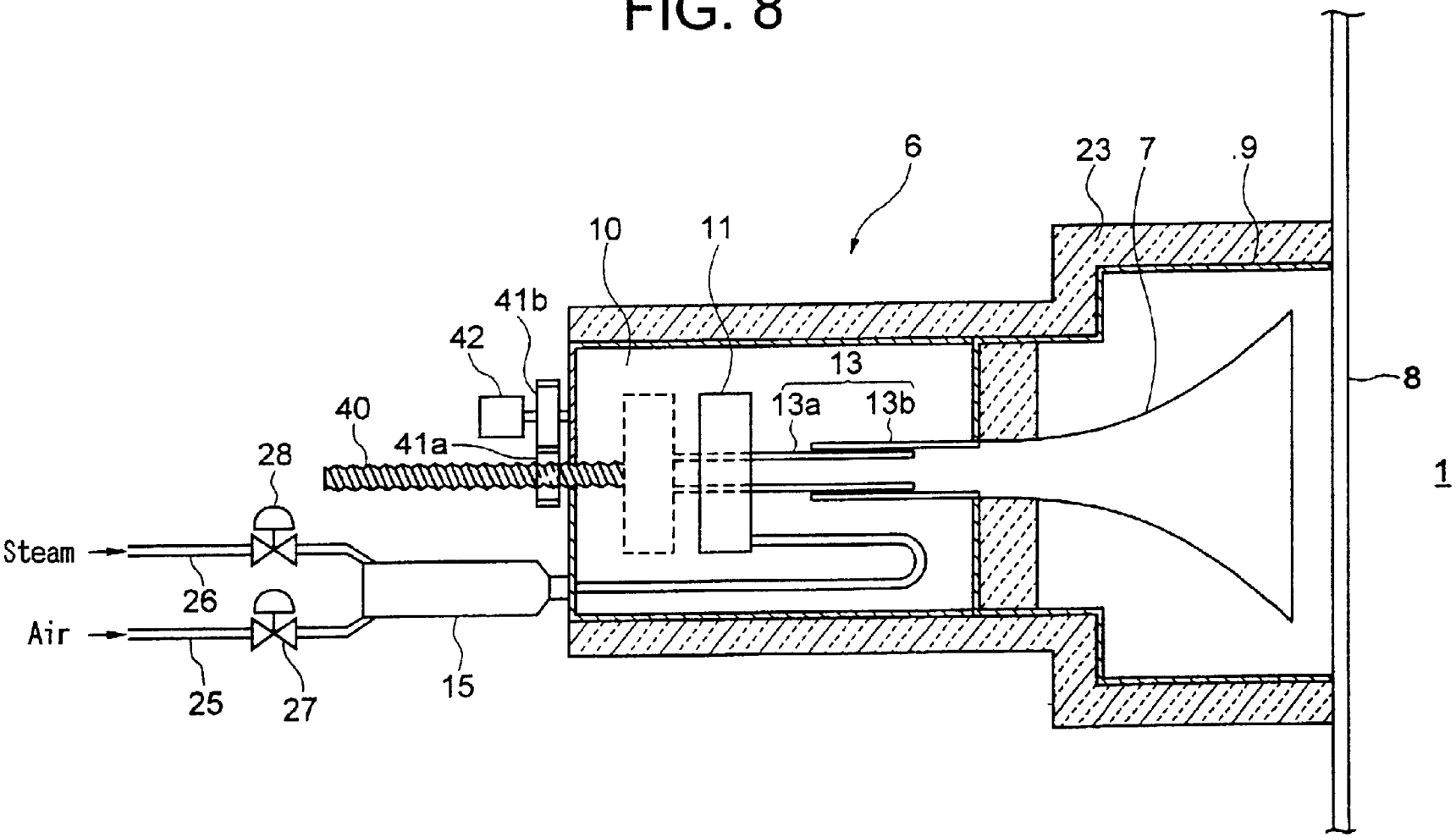
FIG. 8 is a view showing the construction of a sonic soot blower in a boiler according to the embodiment of the invention.

FIG. 8 is an example describing a sonic soot blower 6, according to system (c) of the invention, which is equipped with a gas mixer 15 of two compressive gases each having a different density and a resonance tube 13 having a slide mechanism. Parts of the sonic soot blower 6 shown in FIG. 8, which brings about the same functions as those of the sonic soot blower shown in FIG. 2, are given the same reference numbers, and overlapping description thereof is omitted. The difference between the former blower 6 shown in FIG. 8 and the latter blower 6 shown in FIG. 2 is that the gas mixer 15 is located outside the attachment box 9 and soundproof lagging 23, and the resonance tube 13 installed in the sonic wave oscillator casing 10 is provided with a slide mechanism.

The resonance tube 13 includes an inner tube 13*a* whose end portion is fixed at the sonic wave oscillator 11 that oscillates sonic waves by a compressive mixed gas and an outer tube 13*b* in which the inner tube 13*a* is caused to slide so that the inner tube 13*a* can advance and retreat therein. It is possible to vary the length of the resonance tube 13 by driving a ball screw 40 disposed on the rear side of the sonic wave oscillator 11 by gears 41*a* and 41*b* and motor 42 so that the ball screw can advance and retreat.

Figure 13:
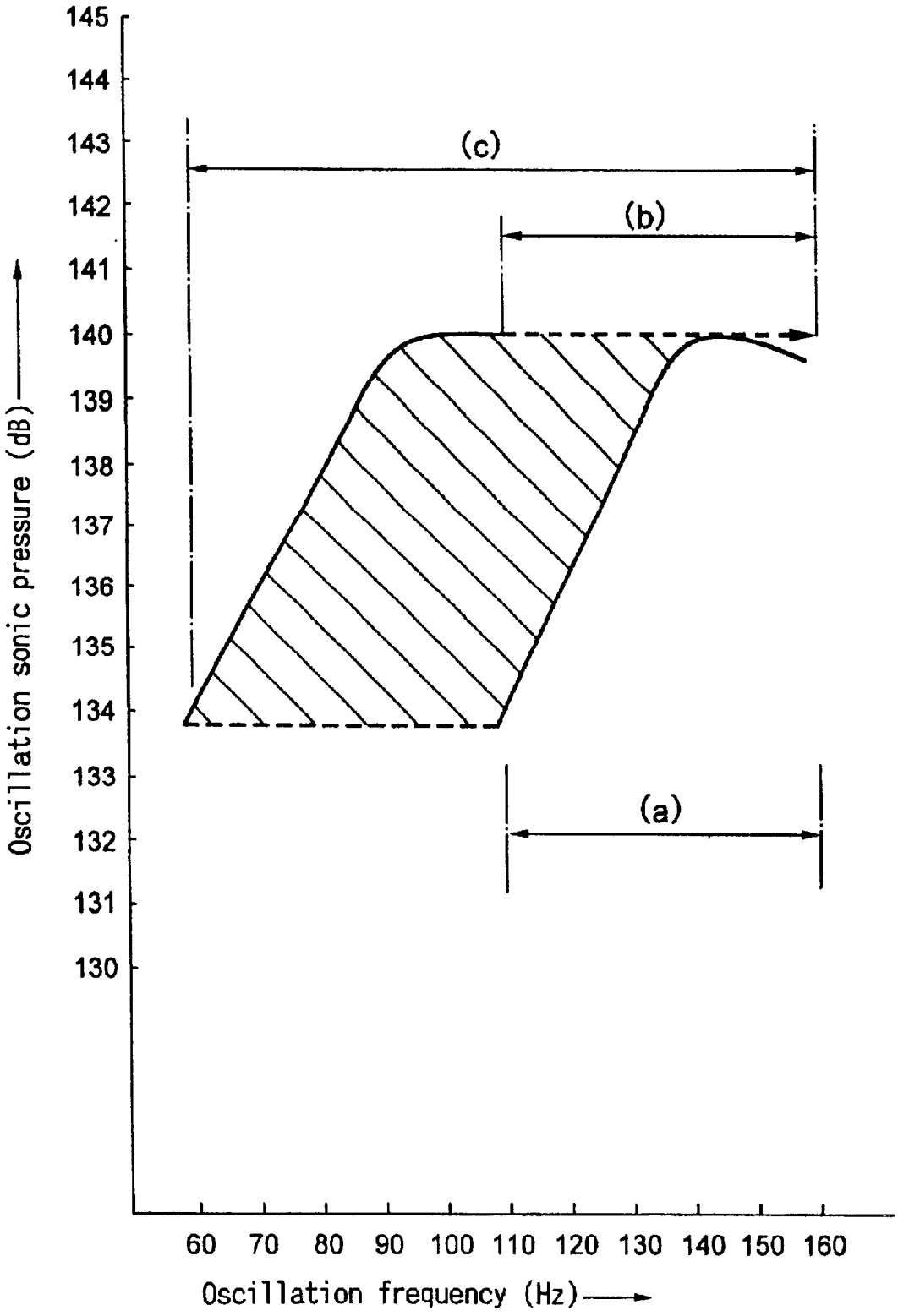
FIG. 13 is a view showing the relationship between the oscillation frequency and sonic pressure of the sonic soot blower shown in FIG. 8.

Using a diagonally lined portion, FIG. 13 shows the relationship between the oscillation frequency and sonic pressure of the sonic soot blower 6 (according to system (c) of the invention), as shown in FIG. 8, which is provided with a gas mixer 15 and a resonance tube 13 to vary the length thereof. The sonic soot blower 6 shown in FIG. 8 is featured in that it can be operated in a comparatively wide range of oscillation frequencies.

Figure 9:
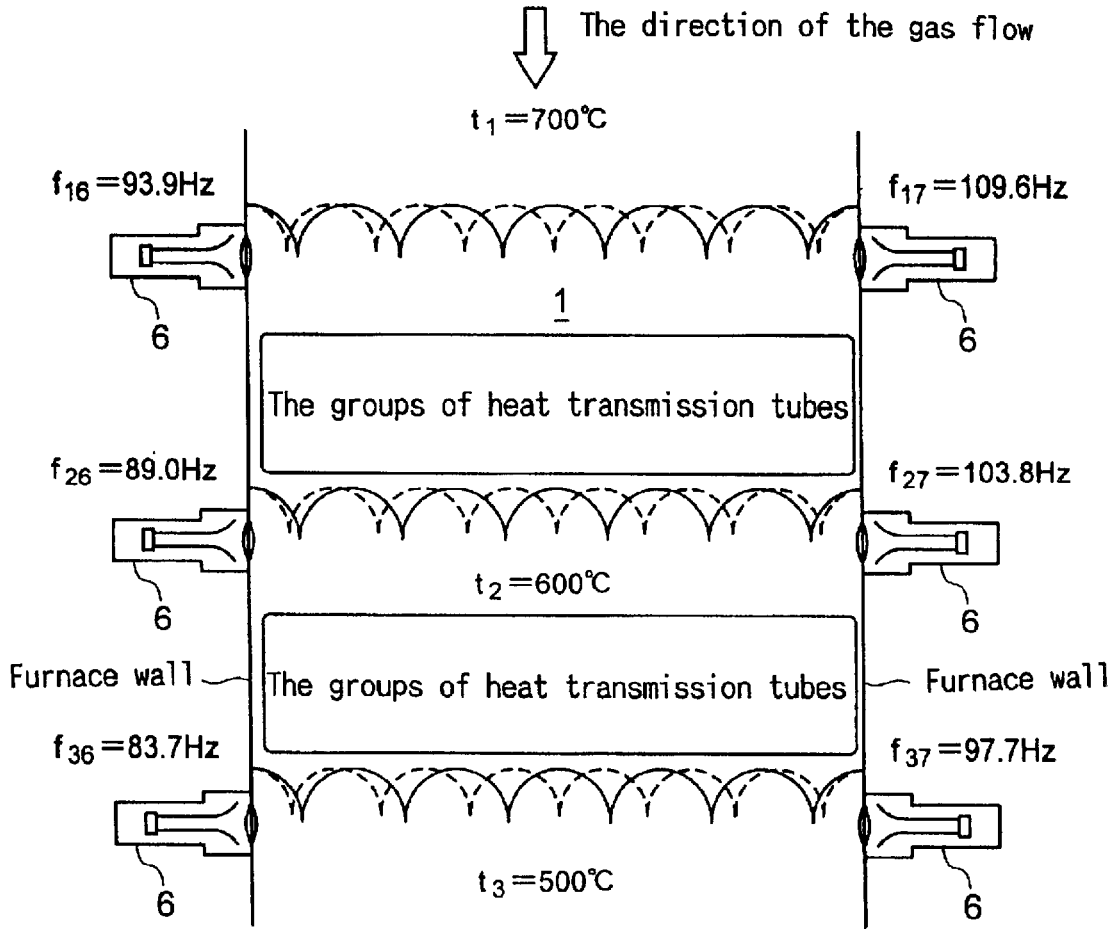
FIG. 9 is a view showing the construction of a sonic soot blower in a boiler according to the embodiment of the invention.

Furthermore, a description with the reference of FIG. 9 is given of an embodiment in which sonic soot blowers 6 equipped with a frequency-regulating portion according to the systems (a) through (c) of the invention are installed on the wall surface of the positions, at which the groups of heat transmission tubes are disposed, of the boiler furnace 1.

As shown in FIG. 9, two or more sonic soot blowers 6, which generate two or more columnar resonance frequencies each having a different frequency from each other, may be disposed per area in the boiler furnace, which is under the same gas temperature conditions. For example, as shown in FIG. 9, sonic soot blowers 6 and 6 that, respectively, oscillate different frequencies from each other may be disposed at the furnace walls opposed to each other so that they are faced to each other. And, such a pair of sonic soot blowers 6 and 6 may be installed on the furnace walls in a plurality of sets. And, in the case where the gas temperature conditions are different from each other in respective areas in the boiler furnace where respective sets of a pair of sonic soot blowers 6 and 6 are disposed (there are three areas whose gas temperature conditions differ from each other in the case of FIG. 9), sonic soot blowers 6 and 6, for which the frequencies are regulated so that columnar resonance frequencies suited to the respective areas in the boiler furnace 1 are generated, are installed.

When the gas temperature conditions in the boiler furnace 1 are known in advance, frequency-fixed sonic soot blowers may be disposed as shown in FIG. 9. Thus, the respective sonic soot blowers 6 can oscillate sonic waves of a frequency which is coincident with the gas temperature conditions of the respective area, and ash adhering to the groups of heat transmission tubes can be removed, and ash is prevented from adhering to the groups of heat tubes.

In a fixed-power generation output boiler, if the sonic soot blowers 6 are operated so that sonic waves are oscillated at frequencies alternately differing from each other area by a area in the boiler furnace 1 that is under the same gas temperature conditions (for example, so that the $6^{th}$ order stationary waves and $7^{th}$ order stationary waves are alternately oscillated), the effects of the removal of ash and prevention thereof from adhering can be improved due to the following reasons.

FIG. 9 shows a state where two sonic soot blowers 6 and 6 are installed in a plurality of sets, in which, with respect to individual gas temperatures, $6^{th}$ order stationary waves (shown by solid lines) and $7^{th}$ order stationary waves (shown by broken lines) are faced toward each other on the opposing furnace walls.

If the $6^{th}$ order and $7^{th}$ order stationary waves are alternately oscillated in the furnace by the frequency-fixed type or frequency-variable type sonic soot blowers 6 and 6, there are some areas in which ash that has adhered to the groups of heat transmission tubes can be removed only by the $6^{th}$ order stationary waves or only the $7^{th}$ order stationary waves, and ash is thereby prevented from adhering thereto. Although the respective areas differ from each other as shown by the $6^{th}$ order or $7^{th}$ order sonic pressure characteristic curves, the above-described different areas are made into areas where ash is removed by both the $6^{th}$ and $7^{th}$ order stationary waves if the $6^{th}$ order and $7^{th}$ order stationary waves are alternately operated, wherein the effect of the removal of ash is further increased. Thus, the method for alternately oscillating columnar resonance frequencies whose orders differ from each other can be easily embodied if a frequency-variable type sonic soot blower 6.

Table 1 below shows the results of the calculation, based on the above-described expression (5), of a change in frequency due to a gas temperature with respect to the resonance orders of the same stationary waves.

TABLE 1

| n | (Sonic velocity) | $6^{th}$ order | $7^{th}$ order |
|---|---|---|---|
| $t_1$ = 700° C. | $C_1$ = 626 m/s | $f_{16}$ = 93.9 Hz | $f_{17}$ = 109.6 Hz |
| $t_2$ = 600° C. | $C_2$ = 593 m/s | $f_{26}$ = 89.0 Hz | $f_{27}$ = 103.8 Hz |
| $t_3$ = 500° C. | $C_3$ = 558 m/s | $f_{36}$ = 83.7 Hz | $f_{37}$ = 97.7 Hz |

However, the sonic velocity C was calculated by the following expression (6), and the furnace width was assumed to be 20 m.

$$C=331.5\times\sqrt{\{(273+t)/273\}} \quad (6)$$

Next, a description is given of an embodiment of a method for selecting the frequency of stationary waves of sonic waves when operating the sonic soot blower according to the invention.

In the general sketch of FIG. 10, a combustion gas thermometer 21 is provided in the vicinity of a group 4 of horizontal type heat transmission tubes, and dust monitors 22, 22 that monitor the dust density in the combustion gas are provided at the lower hopper part 1*a* of the economizer and the outlet duct 1*b* of the economizer, respectively.

Figure 14:
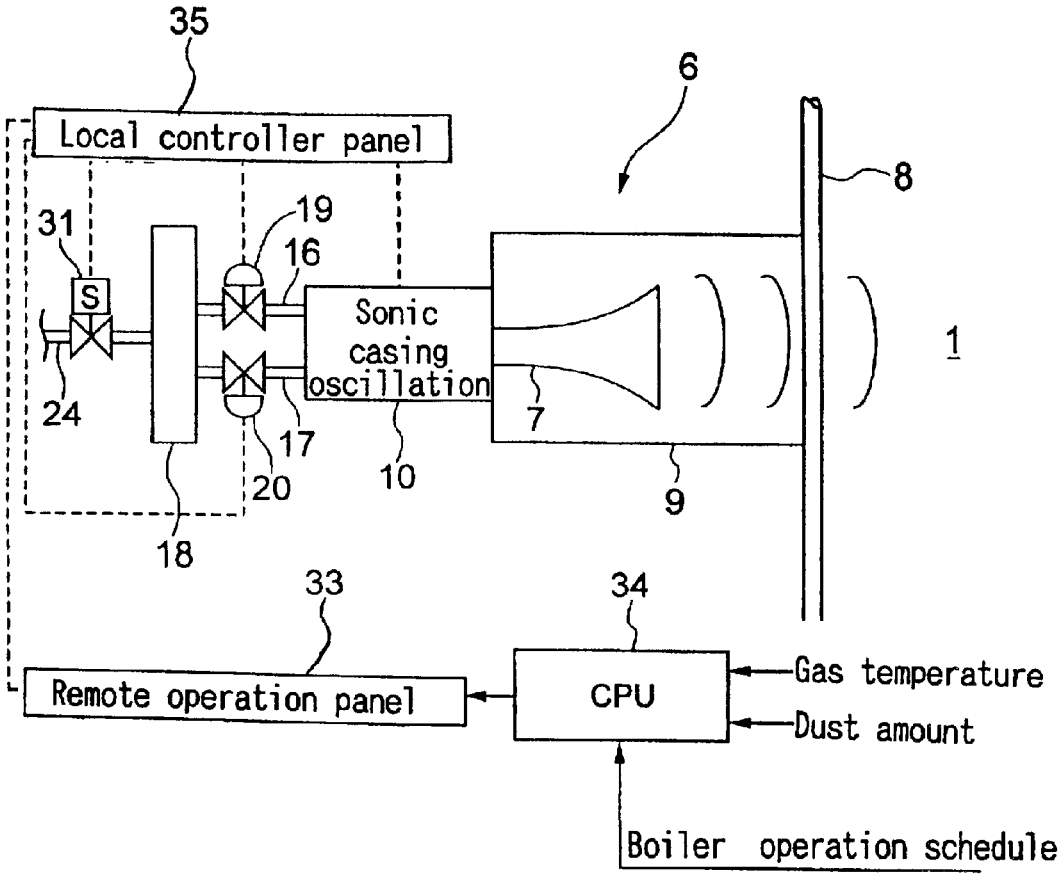
FIG. 14 shows a system for measuring and controlling used to establish the operation of a sonic wave oscillator of the sonic soot blower shown in FIG. 1.

FIG. 14 shows a general constructional view of the sonic soot blower 6 described with respect to FIG. 10. In the sonic soot blower 6 (the detailed structure thereof is shown in FIG. 1) shown in FIG. 14, a sonic wave oscillator casing 10 internally incorporating a sonic wave oscillator 11 equipped with a frequency-regulating portion, and a heat-shielding attachment box 9 internally incorporating a horn 7 to amplify the oscillated sonic waves are provided in an opening of the furnace wall being the water wall or gauge wall 8. Also, a compressed air pipe 24 is provided at the base part of the sonic wave oscillator casing 10, and an electromagnetic valve 31 that turns on and off the sonic wave oscillation by compressed air is provided on the same pipe 24. Two air pipes 16 and 17*b* are connected to the downstream side pipe 24 of the electromagnetic valve 31 via a header 18. Air pressure regulator valves 19 and 20 for adjusting the sonic pressure are, respectively, provided at the air pipes 16 and 17.

Also, it is possible to adjust the oscillation frequency by controlling the air pressure regulator valves 19 and 20 for adjusting the sonic pressure, and to adjust the ON-OFF operation of the sonic wave oscillation by controlling the electro-magnetic valve 31. The control is carried out at a local controller panel 35.

The sonic wave oscillation frequency and sonic pressure of a plurality of sonic soot blowers 6 and the ON-OFF interval of the sonic wave oscillation are controlled by instructions from a remote operation panel 33 located in the central control and operation room. The remote controller panel 33 monitors the gas temperature measured by the combustion gas thermometer 21 and the dust density measured by the dust monitor 22, and obtains the optimal frequency of stationary waves oscillated from individual sonic soot blowers 6, sonic pressure thereof, and interval of the sonic wave oscillation and stopping from the CPU 34 for operation of the sonic soot blowers 6 on the basis of information regarding the boiler operation load. Thus, the operation of the sonic soot blowers 6 is carried out in compliance with the results of the above process.

If the sonic soot blowers 6 installed between banks (the installed portions of groups 3 and 4 of the heat transmission tubes) are operated while continuously varying the operation frequencies of the sonic waves therefrom, a certain operation frequency can establish the stationary waves at the combustion gas temperature. The sonic pressure in the furnace increases remarkably when the stationary waves are established and brought about. As a result, ash is removed from the surfaces of groups 3 and 4 of the heat transmission tubes.

Figure 15:
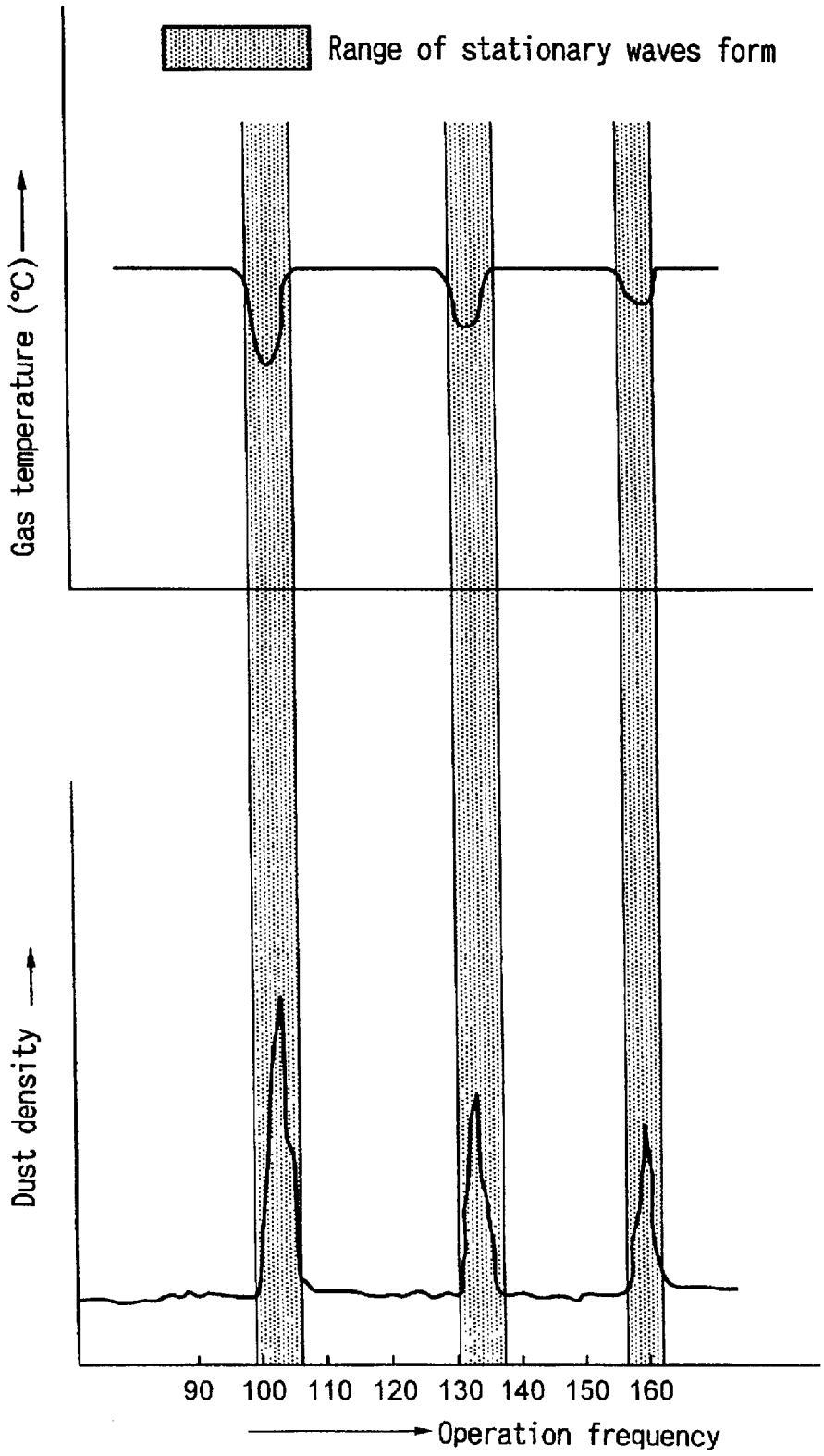
FIG. 15 is a view showing the relationship between a dust density and a gas temperature with respect to stationary waves of sonic waves in a boiler furnace during the operation of a boiler.

As ash is removed from the surfaces of groups 3 and 4 of the heat transmission tubes, the dust density measured by the dust monitor 22 increases. Furthermore, at this time, the heat exchange performance of groups 3 and 4 of the heat transmission tubes is increased greater than in the case where ash has adhered thereto, wherein it is confirmed by the combustion gas thermometer 21 that the gas temperature at the outlet duct 1*b* of the economizer is lowered. Thus, as the phenomenon of the dust density being increased at the rear part heat transmission portion and/or the state where the gas temperature has been lowered can be confirmed, it is possible to confirm the existence of the stationary waves of sonic waves in the boiler furnace 1 and the strength in the removal of ash during the operation of the boiler. This state is shown in FIG. 15.

By the above-described operation, the intensity or its level of the ash removal performance brought about due to the stationary waves of sonic waves in a boiler by the individual sonic soot blowers 6 is recorded with respect to variously varying loads of the boiler.

Next, a description is given of the method for securing the adequate number of times of ON-OFF with respect to the continuous oscillation and stopping of sonic waves for ash removal by the respective frequencies that form stationary waves in the individual sonic soot blowers 6.

The period of time T until ash re-adheres to groups 3 and 4 of the heat transmission tubes after stopping the continuous operation of sonic wave oscillation and stopping by the sonic soot blowers 6 and the amount of ash adhered to groups 3 and 4 of the heat transmission tubes reaches the level of saturation (or the time required until the exhaust gas temperature at the outlet of the boiler is raised to an appointed level) is presumed on the basis of the rise in gas temperature at the combustion gas thermometer 21 (FIG. 10). The sonic soot blowers 6 are again operated for continuous oscillation of sonic waves and stopped by the same time T as the above-described period of time T. At this time, the number of times of ON-OFF with respect to the sonic wave oscillation is variously changed in the period of time T as shown in FIG. 16, the ash removal performance is checked with respect to the respective numbers of times of ON-OFF.

Figure 16:
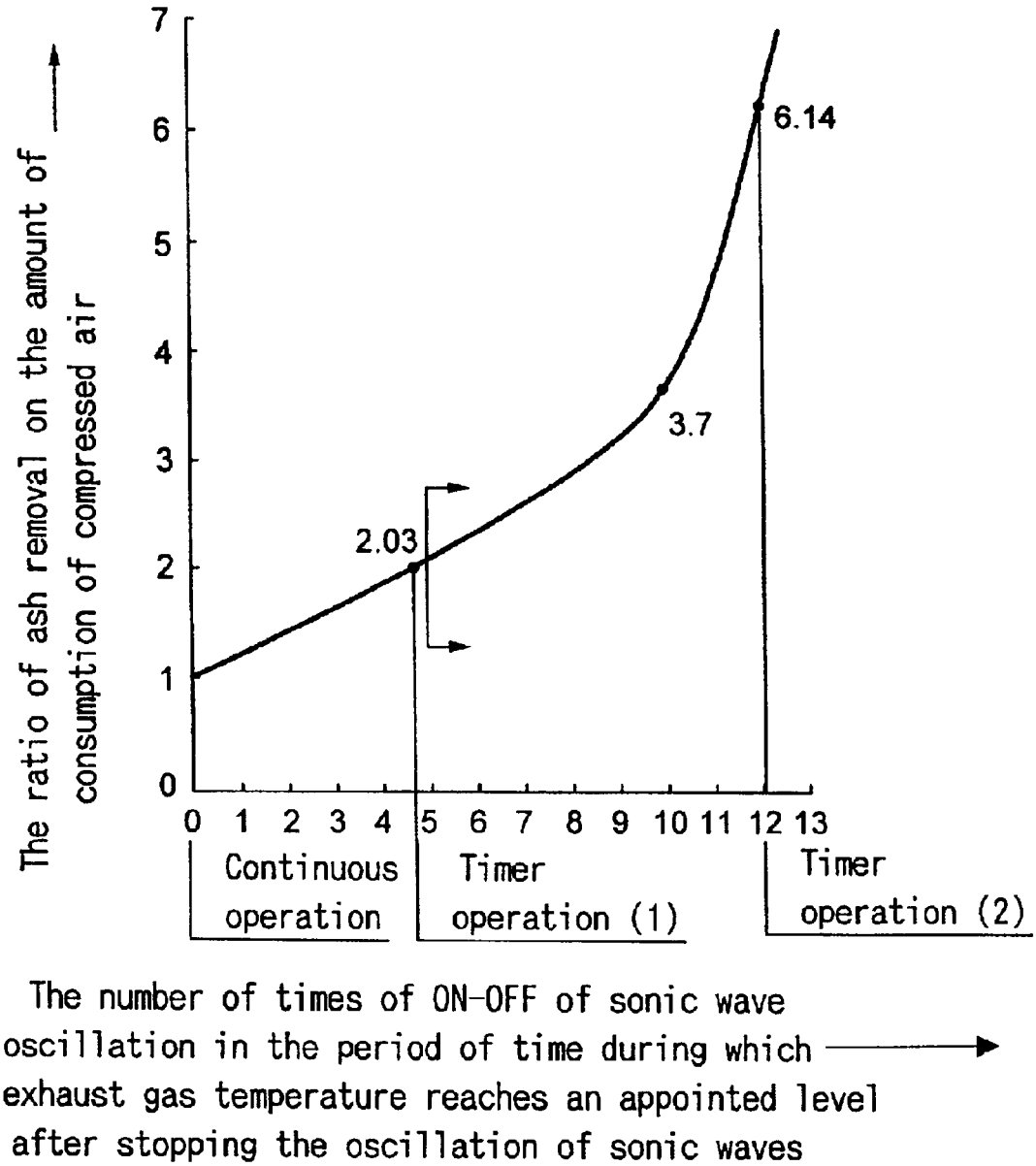
FIG. 16 is a view showing the experimental figures of the amount of dust removal based on changes in the dust density when varying the number of times of ON and OFF of sonic wave oscillation in the period of time during which the exhaust gas temperature reaches an appointed level after stopping the oscillation of sonic waves.
Figure 17:
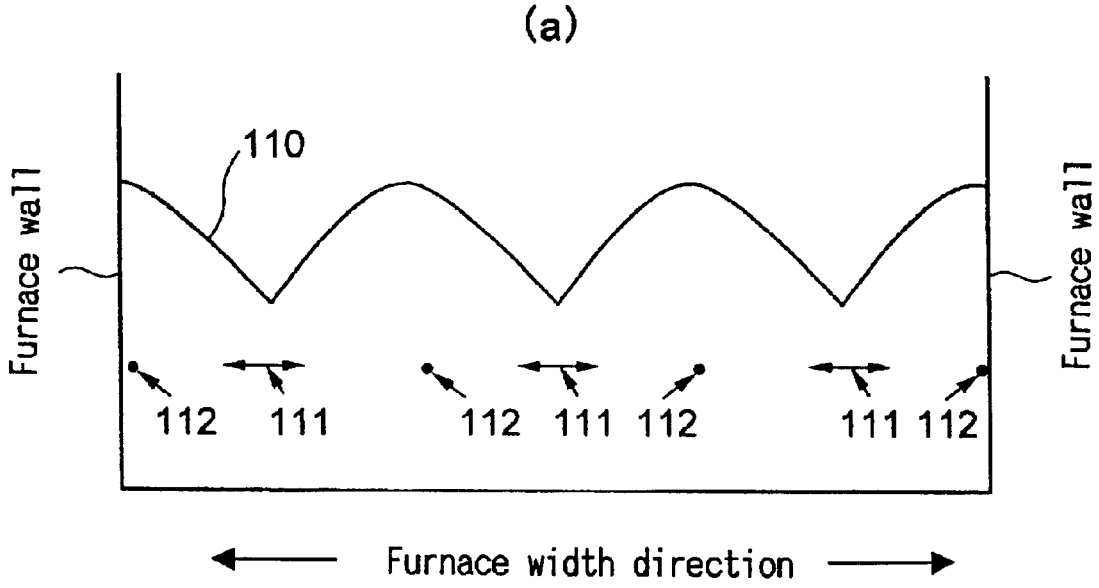
FIG. 17 is a view explaining the mechanism for removing ash by sonic waves, by which the ash removal performance is improved by the ON and OFF operation of the sonic wave oscillation in FIG. 16.
Figure 17:
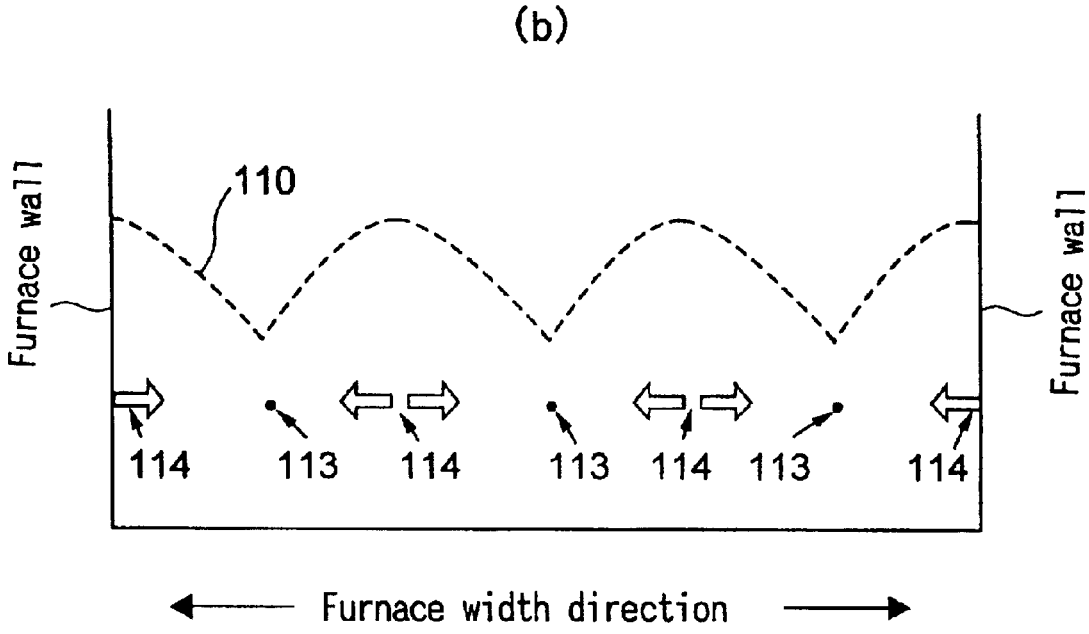

FIG. 16 shows the results that the relationship between the number of times of ON-OFF of sonic wave oscillation in the period of time T when stopping the sonic wave oscillation after sonic waves have continuously been oscillated and the ratio of ash removal (the ash removal ratio in the case when varying the number of times of ON-OFF of the sonic wave oscillation on the basis of the ash removal ratio when continuously oscillating sonic waves) have been obtained on an experimental basis. Timer operation (1) shown in FIG. 16 indicates a case where the number of times of ON-OFF of sonic wave oscillation is five times in an appointed period of time T, and timer operation (2) indicates a case where the number of times of ON-OFF of sonic wave oscillation is twelve times within an appointed period of time T.

Based on the graph shown in FIG. 16, it was understood that the number of times of ON-OFF of sonic wave oscillation in which the ash removal ratio is 2 or more in the above-described period of time T is more than and including five times.

Frequencies forming stationary waves, sonic pressure and ON-OFF interval of sonic wave oscillation, which are thus obtained, are programmed in compliance with the operation loads of the boiler, whereby the operation of the sonic soot blowers 6, which is favorable with respect to ash removal and properties of the boiler operation, can be carried out.

Figure 18:
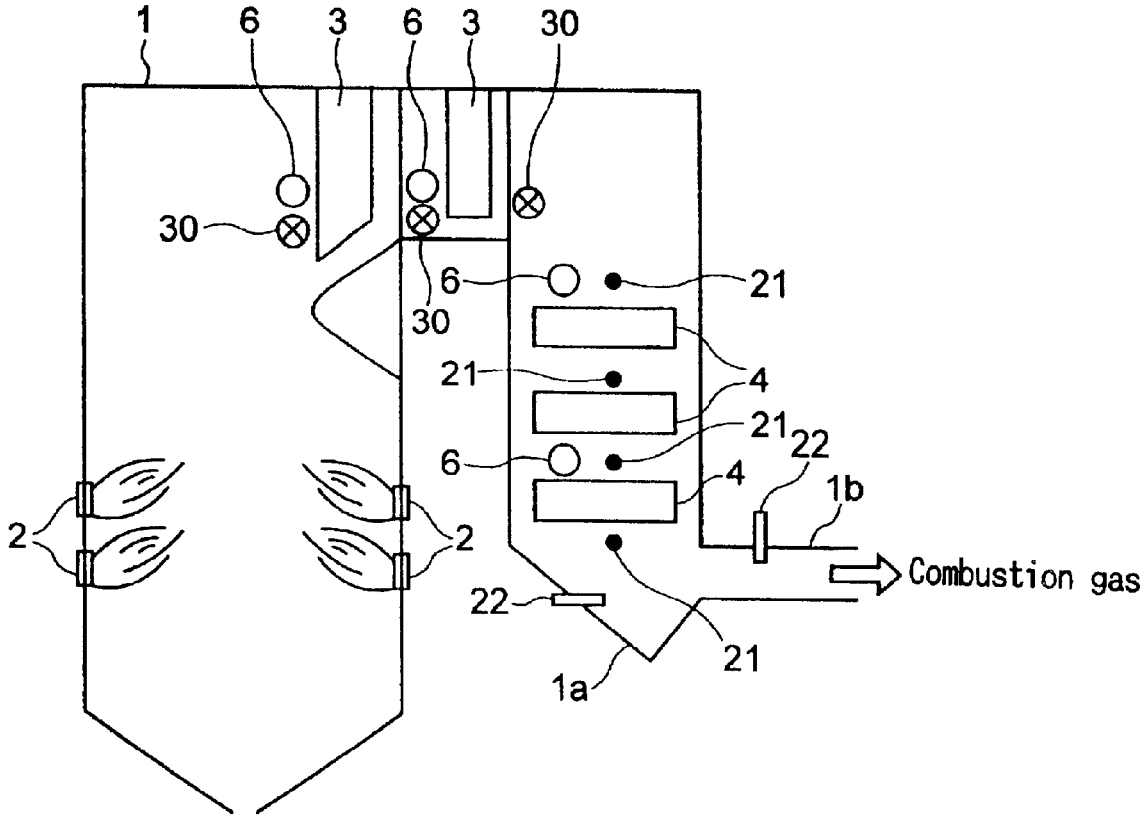
FIG. 18 is a view showing the position of a sonic soot blower in a boiler according to one mode of the invention.

FIG. 18 shows an embodiment of the case where the construction of sonic soot blowers 6 according to the invention, which is to obtain an adequate number of times of ON-OFF when operating the same for continuous sonic wave oscillation and stopping the oscillation is applied to a boiler.

The present embodiment is basically the same as the mode in which the sonic soot blowers 6 shown in FIG. 10 are applied to a boiler. However, since a thermocouple type gas thermometer 21 of FIG. 10 cannot be installed in a high temperature area of the waste combustion gas, at which the group 3 of suspension type heat transmission tubes 3 is provided in the boiler furnace 1, an acoustic type thermometer 30 is installed instead thereof. Since this type of thermometer can continuously measure the combustion gas temperature at the portion where the sonic soot blower 6 is installed, a plurality of optimal frequencies, which form the above-described stationary waves, are added at all times to the figures of the measured gas temperature base for correction with respect to the gas temperature when operating the boiler, wherein ash can be most effectively removed and it becomes possible to control the temperature of steam generated by the boiler.

According to the above-described embodiment of the invention, since it is possible to obtain the frequencies of the stationary waves of sonic waves formed in the boiler furnace 1 during the operation of the boiler and to obtain the period of time T until the adhering of ash occurring due to the stopping of sonic waves to groups 3 and 4 of the heat transmission tubes is saturated, it becomes possible to determine the optimal interval of the oscillation and stopping of sonic waves (or the number of times of ON-OFF with respect to the sonic wave oscillation). Thus, the amount of consumption of compressed air necessary for the oscillation of sonic waves can be decreased. The costs thereof are lowered, and the effect of the removal of ash by sonic waves can be greatly increased.

Thus, the method for operating a sonic soot blower at an optimal interval of the oscillation and stopping of sonic waves is applied to not only the frequency-variable type but also frequency-fixed type sonic soot blowers.

Also, a description is given of an embodiment, in which a combustion gas is used as a cooling gas of a sonic soot blower 6, according to the invention.

Figure 19:
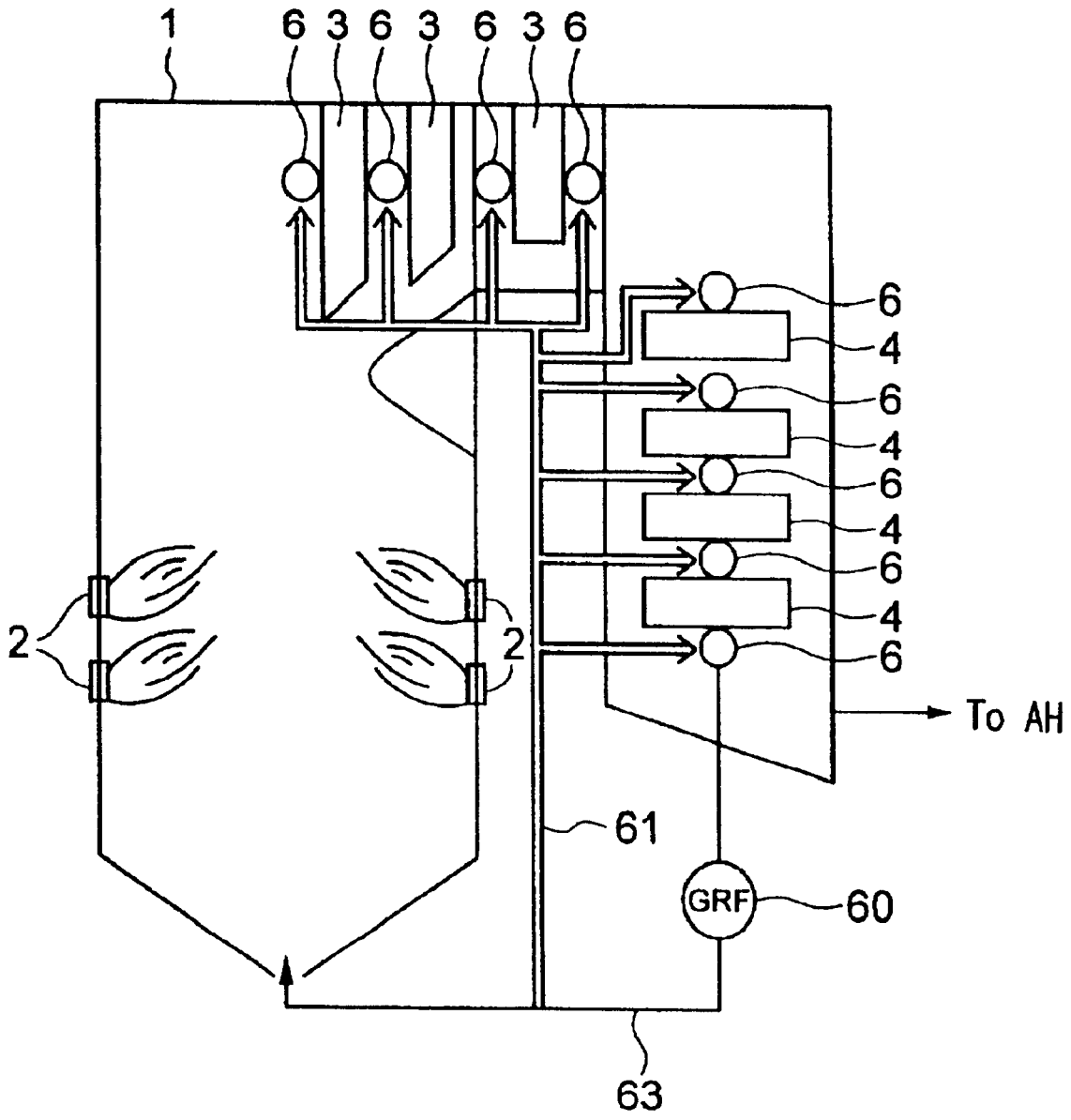
FIG. 19 is a view showing the position of a sonic soot blower in a boiler according to another mode of the invention.

FIG. 19 is a layout diagram showing a line 61 in which the boiler outlet gas is drafted up and is supplied from the outlet of GRF (gas re-circulation fan) 60 to respective sonic soot blowers 6 as a cooling gas.

A burner 2, a group 3 of suspension type heat transmission tubes and a group 4 of horizontal type heat transmission tubes are disposed in the boiler furnace 1, and sonic soot blowers 6 are installed at the respective groups 3 and 4 of heat transmission tubes.

A re-circulation gas line 63 of the GRF 60, which drafts up and returns a part of waste combustion gas to the bottom side of the boiler furnace 1, is provided at the outlet side of the boiler furnace 1. Also, the embodiment is provided with a construction by which the cooling gas supply line 61 is branched from the re-circulation line 63 at the outlet side of the GRF 60 to the respective sonic soot blowers 6.

Figure 20:
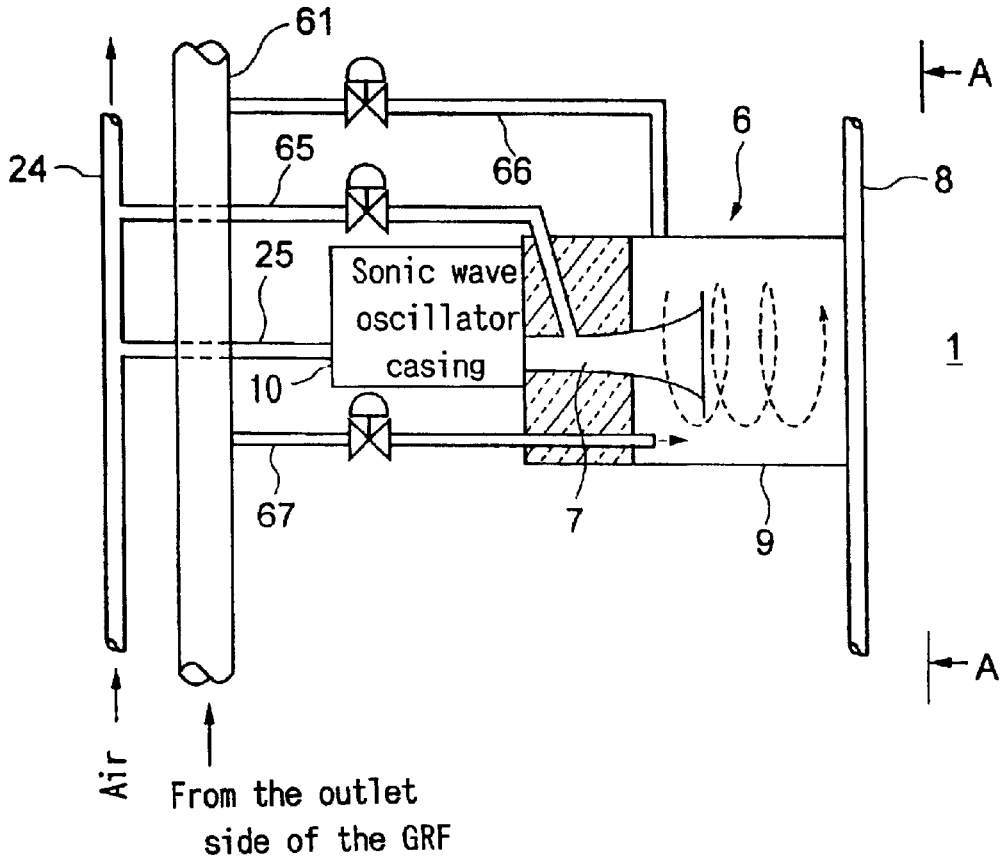
FIG. 20 shows the construction of the sonic soot blower shown in FIG. 19.
Figure 20:
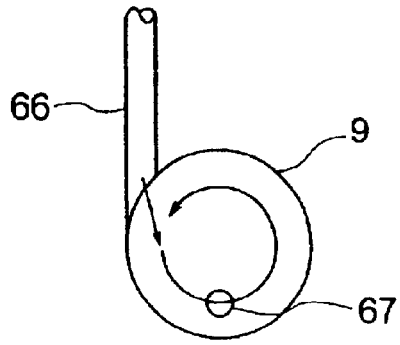

As a general sketch of one of the sonic soot blowers 6 is shown in FIG. 20(*a*), the sonic soot blower 6 is provided with a sonic oscillation casing 10 equipped with a frequency-regulating portion and a horn 7 for amplifying the oscillated sonic waves in the heat-shielding attachment box 9, and the attachment box 9 is provided with an opening of the furnace wall, which is a water wall or a casing wall 8. Further, a sonic wave oscillation compressed air line 25 and a horn cooling compressed airline 65, which are, respectively, branched from the compressed air pipe 24, are installed at the base parts of the sonic wave oscillator casing 10 and horn 7, and the inside of the sonic wave oscillator casing 10 and the horn 7 are cooled by the cooling compressed air from these lines 25 and 65.

In addition, cooling lines 66 and 67 which are bifurcated from the cooling gas supply line 61 are connected to the heat-shielding attachment box 9, wherein a gas existing at the outlet of the GRF 60 is supplied to the inside of the heat-shielding attachment box 9 through the cooling lines 66 and 67 by utilizing the gas in order to cool the sonic soot blowers 6. As shown in FIG. 20(*b*) (the view is taken along the line A—A in FIG. 20(*a*)), a cooling gas is jet fed from the cooling line 66 in the circumferential direction of the inner wall of the heat-shielding attachment box 9, whereby the cooling gas is caused to rotate along the circumferential direction of the corresponding box 9 to increase the cooling effect in the box 9. In addition, a cooling gas is jet fed from the rear side of the heat-shielding attachment box 9 to the forward side (furnace side) through the line 67, and the inside of the heat-shielding attachment box 9 is cooled.

The waste combustion gas temperature at the outlet of the GRF 60 is approx. 300 through 350° C., and is equivalent to or a little higher than the fluid temperature of approx. 300° C. in groups 3 and 4 of the heat transmission tubes. The fluids in the heat transmission tubes are not cooled, and if the above-described gas temperature is 350° C. or less, the strength of the heat-shielding attachment box 9 itself does not matter.

Furthermore, since the ash that has accumulated at the sonic soot blowers 6 is not softened by such a gas temperature, the ash is kept in a porous state even if ash has accumulated. In these situations, since the waste combustion gas, which was drafted up from the GRF 60, is discharged from the sonic soot blowers 6, ash is prevented from adhering to the opening at the water wall or gauge wall 8 side.

At this time, since the constituents of the gas used to cool the inside of the heat-shielding attachment box 9 are the same as those of the gas flowing in the boiler furnace 1, no disturbance occurs in the control of the oxygen density in the boiler furnace 1, and it is not necessary to newly install a compressed air system.

Figure 21:
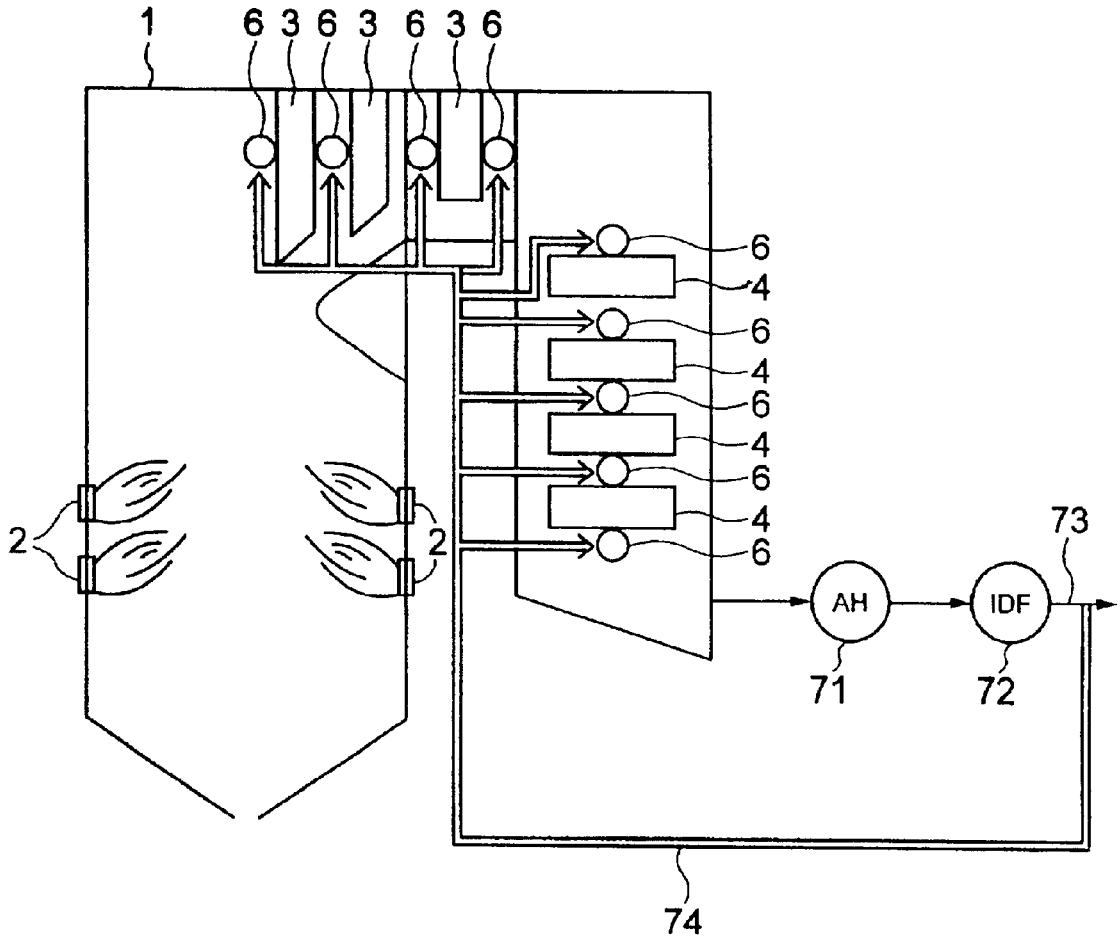
FIG. 21 is a view showing the disposed position of a sonic soot blower in a boiler according to a mode that becomes the invention.
Figure 22:
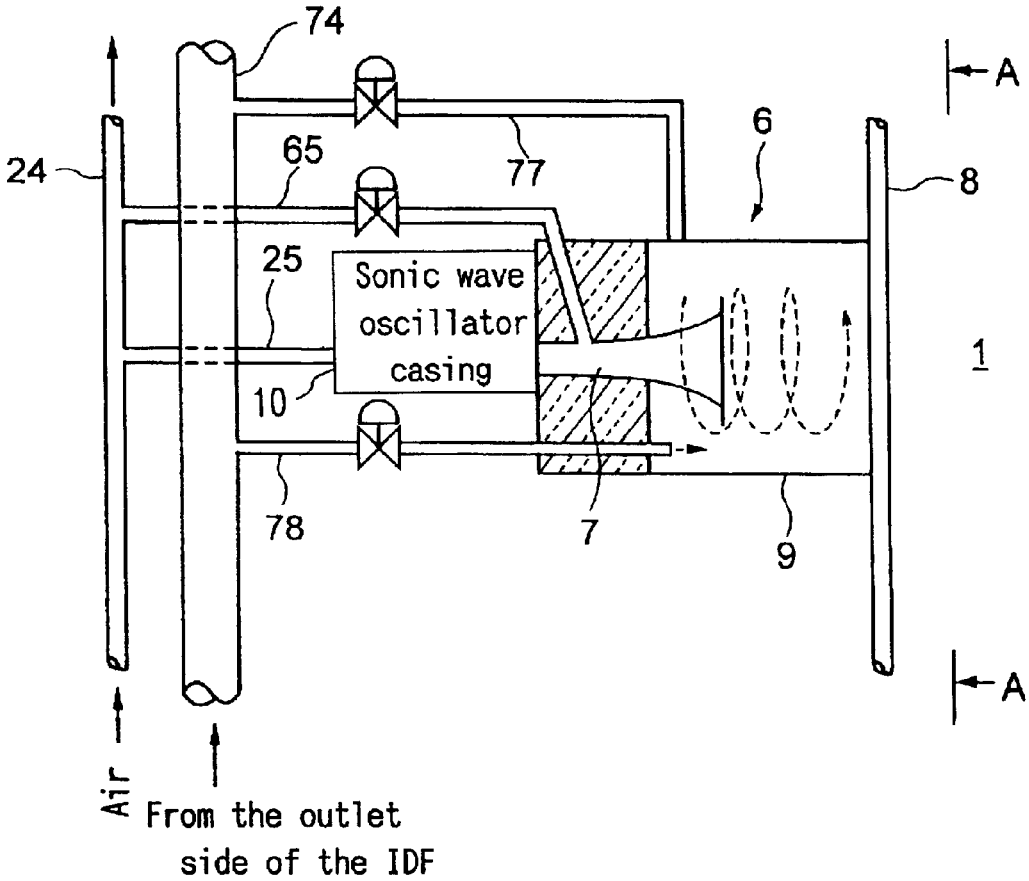
FIG. 22 shows the construction of the sonic soot blower shown in FIG. 21
Figure 22:
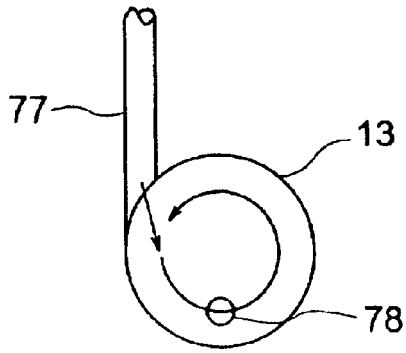

Another mode in which the boiler waste gas is utilized is shown in FIG. 21 and FIG. 22. The mode is applied to a boiler that is not provided with a GRF 60, which is shown in FIG. 19.

The waste combustion gas from the outlet of the boiler furnace 1 is expelled via an air preheater 71 and an IDF (Induced Draft Fan) 72. However, a cooling gas supply line 74 is bifurcated from the gas line 73 at the outlet of the IDF 72, wherein the waste combustion gas is supplied to the respective sonic soot blowers 6. In the heat-shielding attachment box 9 shown in FIG. 22(*a*) (general sketch of the sonic soot blowers 6) and FIG. 22(*b*) (the view taken along the line A—A of FIG. 22(*a*)), a cooling gas supply line 74 is bifurcated from the outlet gas line 73 of the IDF 72 shown in FIG. 21, the cooling lines 77 and 78 are connected to the cooling gas supply line 74, and the inside of the heat-shielding attachment box 9 is cooled by the outlet gas of the IDF 72.

Since the gas temperature of the outlet gas of the IDF 72 is lowered to 110 to 150° C., the cooling effect inside the heat-shielding attachment box 9 is large, and no disturbance in the control of oxygen density in the boiler furnace 1 occurs. Furthermore, it is not necessary to further provide a compressed air system in order to cool the above-described heat-shielding attachment box 9.

Figure 23:
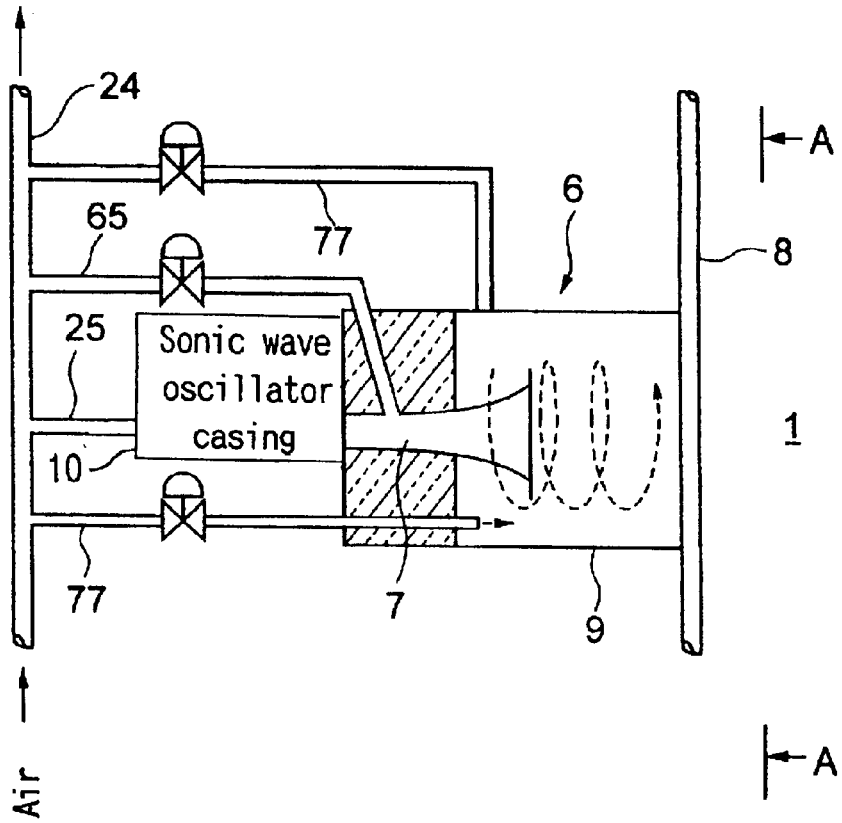
FIG. 23 is a view showing the construction of a sonic soot blower in a boiler according to the embodiment of the invention.
Figure 23:
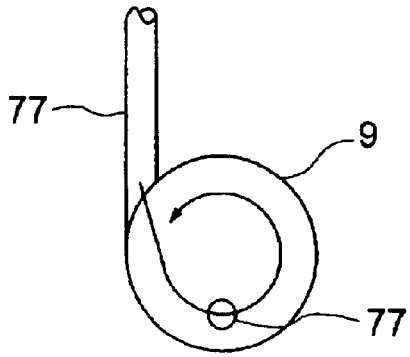

FIG. 23 shows yet another mode of the above-described heat-shielding attachment box 9.

The heat-shielding attachment box 9 shown in FIG. 23(*a*) (general sketch of the sonic soot blowers) and FIG. 23(*b*) (the view taken along the line A—A of FIG. 23(*a*)) is preferable in the case where the number of the sonic soot blowers 6 installed in the boiler furnace 1 are a few (2 through 4 units)

A compressed gas is used as the cooling gas for the heat-shielding attachment box 9. Cooling lines 77 and 77 for the heat-shielding attachment, which are bifurcated from the compressed air pipe 24, are connected to the heat-shielding attachment box 9 in order to cool the heat-shielding attachment 9. The compressed air is at an ordinary temperature, and in comparison with the two embodiments shown in FIG. 20 and FIG. 22 described above, the embodiment shown in FIG. 23 has a the lowest temperature with respect to the cooling compressed air, and the effect of cooling the above-described attachment box 9 is high. Although disturbance is more or less produced with respect to the oxygen density of the boiler furnace 1 if the compressed air is conducted into the boiler furnace 1, the disturbance is such that it does not matter. Also, the existing facility can cope with the compressed air system.

In addition, in the case where no blowing port from the cooling line 77 shown in FIGS. 23(*a*) and (*b*) to the heat-shielding attachment box 9 is provided, where ash may be prevented from accumulating.

The following problems arise in the case where the sonic soot blowers 6 according to the invention are applied to the wall surface of a boiler furnace.

The pressure in the furnace 1 is adjusted to less than the atmospheric pressure (−100 through −50 mmAq) for the safety when operating the boiler furnace 1. Therefore, where a difference in the pressure between the inside of the boiler furnace 1 and that of the sonic soot blowers 6 varnishes when stopping the operation of the boiler, and when the temperature of the gas in the sonic soot blowers 6 is remarkably lower than the temperature of the in-furnace gas (that is, immediately after stopping the operation of the boiler), humidity in the gas constituents is condensed in the sonic soot blowers 6, wherein drain containing intensively corrosive constituents adheres to the inner wall of the sonic soot blowers 6 or the members installed in the sonic soot blowers 6, and these parts may become corroded.

Figure 24:
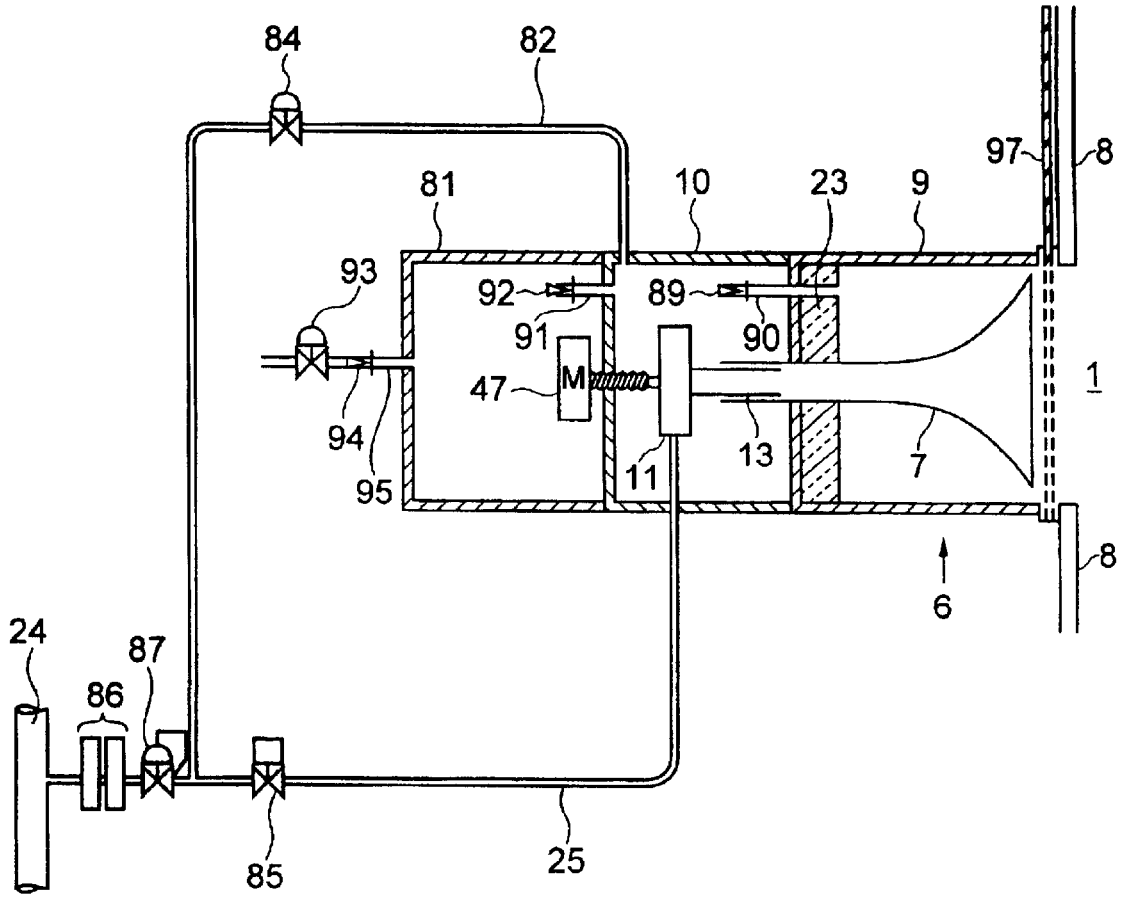
FIG. 24 is a view explaining a safety mechanism when the sonic soot blower according to the embodiments of the invention is installed at the wall surface of a boiler.

In the embodiments of the invention, a description is given of the countermeasure to prevent dirty gases in the boiler furnace 1 from invading the sonic wave oscillator casing 10, using a general construction view of the sonic soot blowers 6 for which the length of the resonance tubes 13 shown in FIG. 24 is variable.

In the sonic soot blowers shown in FIG. 24, a sonic wave oscillator 11 and a slidable resonance tube 13 of a double-tubular structure are disposed in the sonic wave oscillator casing 10, and a horn 7 is disposed in the heat-shielding attachment box 9. The attachment box 9 is provided with an opening of the furnace wall, which is a water wall or a gauge wall 8. In addition, a motor/sensor accommodation box 81 is provided at the rear part of the heat-shielding attachment box 9, which accommodates a motor 47 for adjusting the length of the resonance tube 13 and sensors (not shown) for checking the slide movement. A compressed air line 25 for sonic wave oscillation and a cooling compressed air line 82, which are, respectively, bifurcated from the compressed air pipe 24, are connected into the space of the sonic wave oscillator casing 10 and to the resonance tube 13. A needle valve 84 is installed in the line 82, and a magnetic electric valve 85 is installed in the line 25. Furthermore, a filter 86 and a pressure regulator valve 87 are provided in the line 25 at the upstream side from the bifurcated part of the line 82.

A pressure-uniforming tube 90 equipped with a check valve 89 is provided at the connection part between the heat-shielding attachment box 9 and the sonic wave oscillator casing 10. In addition, the inside of the sonic wave oscillator casing 10 is caused to communicate with the inside of the motor/sensor accommodation box 81 by the pressure-uniforming tube 91 equipped with a check valve 92. Also, the inside of the motor/sensor accommodation box 81 is caused to communicate with the atmospheric air via the pressure-uniforming tube 95 equipped with a ball valve 93 and a check valve 94. Further, a gas inflow preventing damper 97, which prevents the in-furnace gas from entering the sonic soot blowers 6, is provided in the opening of the heat-shielding attachment box 9 at the furnace 1 side.

Using the construction shown in FIG. 24 described above, a description is given of the countermeasure for preventing a dirty gas in the boiler furnace 1 from entering the sonic wave oscillator casing 10 with respect to three cases in which (1) is when normally operating the boiler, (2) is immediately after stopping the operation of the boiler, and (3) is when carrying out maintenance work of the sonic soot blowers 6.

(1) When Normally Operating the Boiler

By causing the atmospheric air to flow into the sonic soot blowers 6 via pressure-uniforming tubes 95, 91 and 90 equipped with check valves 94, 92 and 89 since the in-furnace pressure is sufficiently lower than the atmospheric air pressure, the combustion gas in the furnace 1 can be prevented from entering the sonic soot blowers 6. At the same time, with the atmospheric air passing through the pressure-uniforming tubes 95,91 and 90 equipped with check valves 94, 92 and 89, the motor/sensor accommodation box 81 to the sonic wave oscillator casing 10 further including the heat-shielding attachment box 9 can be cooled.

Also, since the gas flow is given resistance in the process for the atmospheric air to pass through the check valves 94 and 92 by using the ball valve 93 and the draft pressure of the sonic wave oscillator casing 10 is made almost the same as the in-furnace gas pressure, a lowering of the sonic oscillation performance of the sonic oscillator casing 10 can be prevented.

In addition, since there is no difference between the inside of the sonic wave oscillator casing 10 and the inside of the furnace 1, sealing air can be supplied by the needle valve 84 installed in the line 82, wherein the gas in the furnace 1 can be prevented from unexpectedly entering the sonic wave oscillator casing 10 when operating the boiler.

(2) Immediately After Stopping the Operation of the Boiler

As the operation of the boiler is stopped, the in-furnace pressure is raised above the atmospheric pressure by the chimney effect in the furnace 1 immediately after. At this time, it is possible to prevent the in-furnace gas from invading the sonic wave oscillator casing 10 by the check valve 89. However, the in-furnace gas may leak out of the check valve 89, and the possibility that a slight amount of the in-furnace gas will invade the sonic wave oscillation casing 10 may remain.

To prevent this, the needle valve 84 secured in the line 82 is opened to supply the sealing air, whereby the draft pressure in the sonic wave oscillator casing 10 is elevated, the in-furnace gas can be prevented from invading the inside of the sonic wave oscillator casing 10 immediately after stopping the operation of the boiler. The inflow of the in-furnace gas into the motor/sensor accommodation box 81 can be prevented by the check valve 92 and sealing air filled in the sonic wave oscillator casing 10.

(3) When Carrying out Maintenance Work on the Sonic Soot Blowers 6.

When entirely attaching or replacing the sonic soot blowers 6, or when carrying out maintenance work on the entire sonic soot blowers 6 and when carrying out maintenance work of only the horn 7, the gas inflow prevention damper 97 that closes the opening of the wall of the furnace 1 is lowered, so that the in-furnace gas does not flow in the sonic soot blowers 6.

The respective operations with respect to the types of maintenance of the sonic soot blowers 6 are summarized in Table 2 below:

TABLE 2

| | Countermeasures for safety | | | |
|---|---|---|---|---|
| Type of maintenance | Gas inflow prevention damper 97 is used | Needle valve 84 is used | Check valve 89 is used | Check valve 92 is used |
| In the motor/sensor accommodation box 81 | — | ○ | ○ | ○ |
| In the sonic wave oscillator casing 10 (not including the replacement of an oscillation plate) | — | — | ○ | — |
| In the sonic wave oscillator casing 10 (including the re-placement of an oscillation plate) | ○ | — | — | — |
| In the heat-shielding attachment box | ○ | — | — | — |
| Entire attachment and replacement of the sonic soot blowers 6 when operating an denitration apparatus, etc. | ○ | — | — | — |

Also, since the resonance tube 13 having a slide mechanism includes a sliding portion, it is necessary to coat grease on the corresponding sliding portion. Therefore, it is necessary to cool the temperature to less than hundred and several tens of degrees (for example, 180° C.) to keep the grease, etc. in a stable state. The sliding portion of the resonance tube 13 is air-cooled as described above. But, since the temperature of the corresponding sliding portion is further lowered in comparison with the in-furnace gas temperature of 300 through 400° C., the in-furnace gas may condense even if even a slight amount thereof enters devices of the sonic wave oscillator casing 10, highly corrosive minute drain may adhere to the above-described sliding portion. Once the corrosive substances adhere to the above-described resonance tube 13, the operation will become difficult due to the remarkable amount of corrosion.

Therefore, fluorocarbon resin baked painting, which has excellent corrosion-resisting and wear-resisting properties, is applied to the above-described sliding portion, and anti-corrosive paint is coated to the sonic wave oscillator casing 10 other than the sliding portion and to the interior surface of the heat-shielding attachment box 9 that is the horn-accommodating portion.

Figure 25:
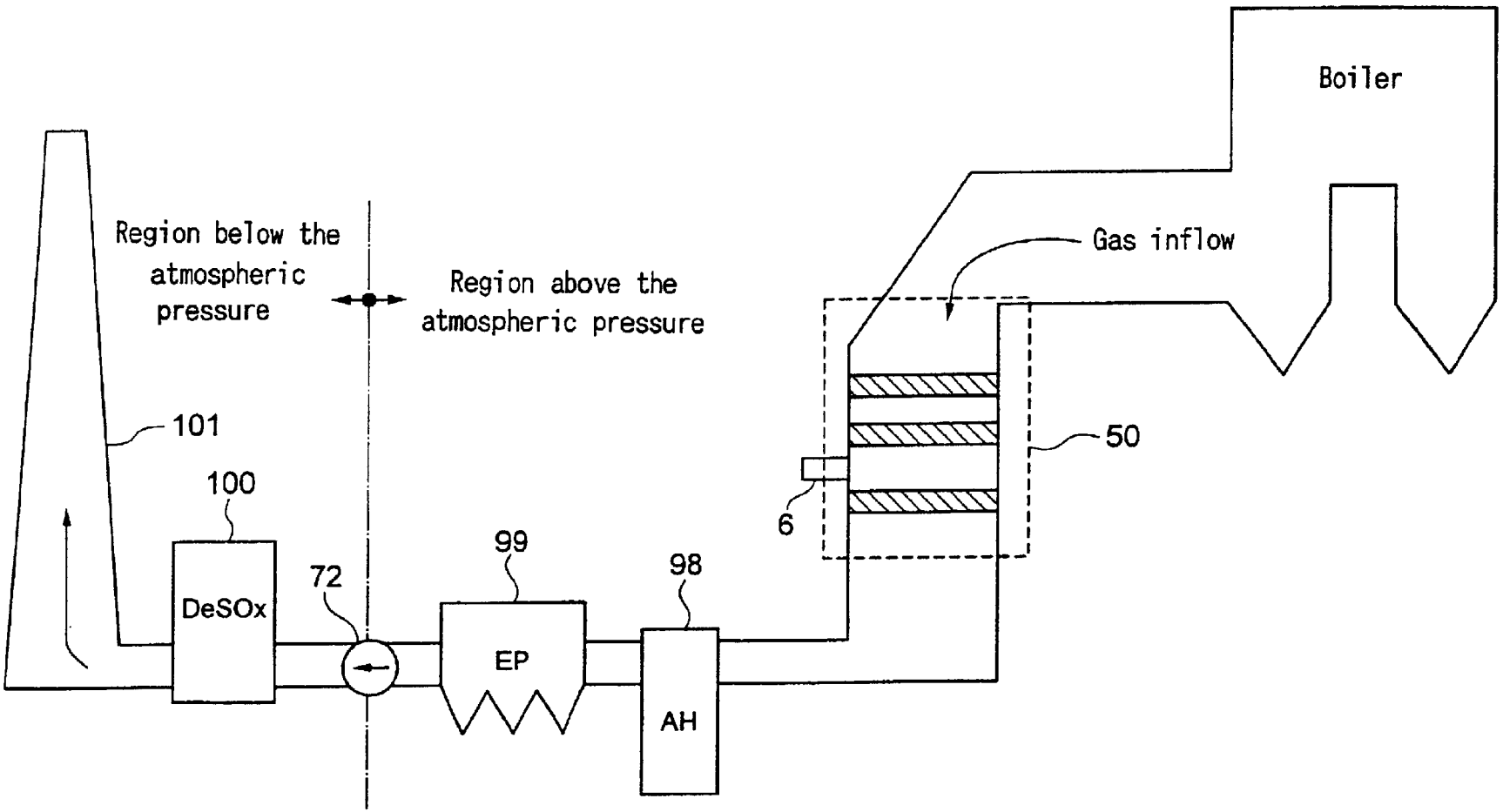
FIG. 25 is a constructional view of an exhaust gas flow of the boiler to which the sonic soot blower according to the embodiments of the invention is applied.

In addition, FIG. 25 is a constructional view of a waste gas flow channel of a boiler to which a frequency-variable type or a frequency-fixed type sonic soot blower according to the embodiments of the invention is applied. As for the boiler waste gas of a thermal power generation plant, nitrogen oxides in the waste gas are removed by a denitration apparatus 50. Next, after the boiler combustion air is preheated by an air preheater 98, soot and dust in the waste gas are removed by a dust collector 99. Thereafter, by a suction fan 72, waste gas is sent into a desulfurization apparatus 100, in which sulfur oxides in the waste gas are removed, and the purified gas is exhausted into the atmospheric air through a chimney 101.

Thus, harmful constituents and soot or dust in the waste gas are removed and exhausted into the atmospheric air. But, nitrogen oxides contained as harmful constituents in the waste gas are removed in the waste gas flow channel located in a comparatively high temperature area, that is, by the denitration apparatus 50 disposed at the upstream side of the waste gas flow channel. This is because a denitration catalyst will be active in a comparatively high temperature area.

Since the denitration apparatus 50 is thus disposed at the upstream side of the waste gas flow channel, wherein as a waste combustion gas containing a great deal of soot and dust flows in the denitration apparatus 50, a great deal of soot and dust adhere to the denitration catalyst disposed in the denitration apparatus 50.

Figure 26:
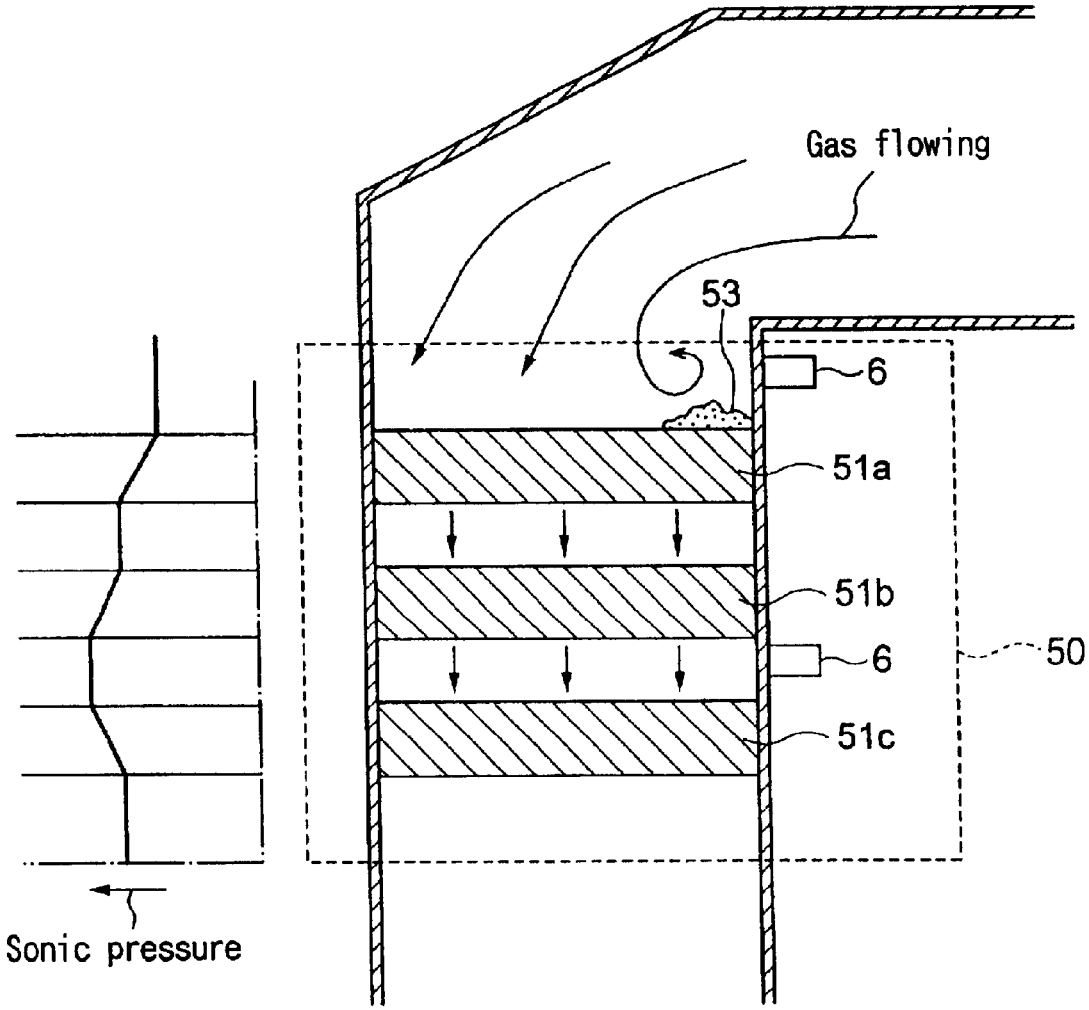
FIG. 26 is a view explaining the functions where the sonic soot blower according to the embodiments of the invention is disposed at the portion of the denitration apparatus in the boiler exhaust gas flow.

FIG. 26 shows denitration catalyst layers 51*a* through 51*c* disposed in multilayers with a spacing therebetween in the gas flowing direction in the above-described denitration apparatus 50. The respective denitration catalyst layers 51*a* through 51*c* are composed of a composite structure, in which a plurality of catalyst units each including a plurality of plate-shaped catalyst elements, on the surface of which a denitration catalyst is coated, laminated with a spacing therebetween, are combined, wherein the waste gas is denitrated while it flows between the corresponding catalyst elements.

Since soot and dust in the exhaust gas are likely to adhere on the plate-shaped catalyst elements of the above-described denitration catalysts 51*a* through 51*c*, the soot and dust are removed by a sonic soot blower according to the invention, whereby the catalysts of the entire denitration apparatus are cleaned.

As differences in the sonic pressure between the respective catalyst layers 51*a* through 51*c* are shown in the left side graph of FIG. 26, it is effective to gradually increase the in-furnace sonic pressure of the oscillation frequency by the sonic soot blowers 6 to remove ash and to prevent ash from adhering, in compliance with the gas flowing from the upstream side of the waste gas flow to the downstream side thereof. The reasons are described below:

Since the waste gas first flows into the catalyst element of the first denitration catalyst layer 51*a* at the extreme upstream side of the gas flow, soot and dust such as ash is liable to adhere thereto, and an accumulation layer 53 is likely to occur. However, if such an in-furnace sonic pressure distribution is created, in which the above-described sonic pressure at the inlet part of the first denitration catalyst layer 51*a* at the extreme upstream side is set to a level (120 dB or more) capable of removing ash and preventing ash from adhering and the sonic pressure is increased on the second and third denitration catalyst layers 51*b* and 51*c* at the downstream side of the gas flow, the ash in the catalyst element of the first denitration catalyst layer 51*a* are removed, and ash can be prevented from readhering.

Also, ash in the waste gas that normally flows is added to the ash separated from the first denitration catalyst layer 51*a* on the catalyst element of the second denitration catalyst layer 51*b*, wherein a gas whose ash density is condensed flows. The ash density will be gradually increased toward the downstream side catalyst layer. Therefore, the sonic pressure at the second denitration catalyst layer 51*b* is further increased than the sonic pressure at the first denitration catalyst layer 51*a*, whereby the ash is prevented from adhering in the second denitration catalyst layer 51*b*. Since the ash density of the catalyst element in the third denitration catalyst layer Sic is on almost the same level as that on the catalyst element of the second denitration catalyst layer 51*b*, the ash is removed in the third denitration catalyst layer 51*c* and are prevented from adhering thereto if the sonic pressure of the third denitration catalyst layer 51*c* is almost the same as that of the second denitration catalyst layer 51*b*.

As described above, by increasing the sonic pressure distribution of the oscillation frequency by the sonic soot blowers 6 from the upstream side of the waste gas flow to the downstream side, it is possible to remove ash and to prevent ash from adhering on catalyst elements of all the denitration catalyst layers 51*a* through 51*c* in the denitration apparatus 50.

Therefore, if the denitration catalyst layers 51*a* through 51*c* consisting of, for example, three layers as shown in FIG. 26 are installed, it is preferable for the sonic soot blowers 6 according to the invention to be installed on the wall surface of the waste gas flow between the second denitration catalyst layer 51*b* and the third denitration catalyst layer 51*c*.

In addition, since the waste gas first flows in the catalyst elements of the first denitration catalyst layer 51*a* at the extreme upstream side of the waste gas flow in the denitration apparatus 50, soot and dust such as ash are likely to adhere. In particular, a part of the waste gas flow becomes a swivel flow if, as shown in FIG. 26, there is an area where the orientation of the waste gas flow is changed in the waste gas flow or an area where a drift flow is produced, and if the first denitration catalyst layer 51*a* is located in the vicinity of the swivel flow, there is a tendency where portions (accumulation layer 53) in which ash is locally accumulated occur.

Accordingly, if the sonic soot blowers 6 according to the invention are disposed on the wall surface of the waste gas flow channel near the portions where a swivel flow occurs in the waste gas flow, it is possible to positively remove ash and to positively prevent ash from adhering, at portions where ash is liable to accumulate on the first denitration catalyst layer 51*a*.

Soot blower-installed equipment in which a plurality of layers according to the invention are disposed includes a waste heat recovery boiler (HRSG), accumulation type heat exchanger, and portions, in which groups of heat transmission tubes are disposed, of a boiler furnace in addition to the above-described denitration apparatus.

Industrial Applicability

According to the invention, sonic soot blowers can be attached directly to soot blower-installed equipment such as a boiler, in which a high temperature combustion gas flows, for example, a boiler, a furnace, an incinerator, an independent superheater, an independent economizer, various types of heat exchangers, or various types of plants or various types of industrial apparatuses. Furthermore, since free adjustment of the oscillation frequencies can be performed in the sonic soot blowers according to the invention even during the operation of the soot blower-installed equipment, the sonic soot blowers can function over a wide range of operation conditions, and it is possible to effectively remove ash accumulated on members disposed in the boiler.

What is claimed is:

1. A sonic soot blower comprising a sonic wave oscillator internally incorporating an oscillation plate to be oscillated by using a compressive gas, a resonance tube connected downstream to the sonic wave oscillator, and a horn, connected downstream to the resonance tube, for resonating the sonic waves oscillated by said sonic wave oscillator for amplifying the same, which removes powdery dust adhered onto members in soot blower-installed equipment and prevents the same from adhering to said members, a frequency-regulating portion for regulating the frequency of sonic waves oscillated by a sonic wave oscillator, comprising a gas mixer connected to the upstream side of said sonic wave oscillator and equipped with two or more gas conducting flow channels, which conduct compressive gases whose temperatures and/or densities are different from each other.

2. The sonic soot blower according to claim 1, wherein said sonic wave oscillator includes a means for oscillating sonic waves by compressed air and/or steam.

3. The sonic soot blower according to claim 1, wherein the respective gas conducting flow channels of said gas mixer is provided with a means for regulating the flow amount thereof.

4. The sonic soot blower according to claim 3, further including a control device for controlling the sonic velocity of oscillating sonic waves by varying the ratio of mixture of compressive gases in a gas mixer by the control of the amount of flow of the compressive gases by means of the flow amount regulating means secured in the respective gas conducting flow channels of said gas mixer.

5. The sonic soot blower according to claim 3, wherein said gas conducting flow channels of the gas mixer is provided with at least a gas conducting flow channel directly connected to the gas mixer and a bifurcated gas conducting flow channel, which is bifurcated from said compressive gas flow channel and is connected to said gas mixer via a bypassing channel secured in the vicinity of the furnace wall of soot blower-installed equipment.

6. The sonic soot blower according to claim 3, wherein the gas conducting flow channels of the gas mixer comprise an air conducting flow channel and/or a steam conducting flow channel.

7. The sonic soot blower according to claim 3, wherein the length of said resonance tube is fixed.

8. The sonic soot blower according to claim 3, wherein the length of said resonance tube is variable.

9. The sonic soot blower according to claim 3, wherein said horn is surrounded by a heat-shielding attachment box installed at one end in an opening in a wall surface of the soot blower-installed equipment, and said resonance tube, sonic wave oscillator and gas mixer are surrounded by a sonic wave oscillator casing provided adjacent to a second end of said attachment box.

10. The sonic soot blower according to claim 9, wherein said heat-shielding attachment box and sonic wave oscillator casing are covered by heat-shielding and/or soundproof lagging.

11. The sonic soot blower according to claim 1, wherein the frequency-regulating portion further comprises a slide mechanism installed at said resonance tube and capable of varying the length of said resonance tube between the sonic wave oscillator and horn, and the slide mechanism of said resonance tube comprises an inner tube connected to the sonic wave oscillator side and an outer tube that is slidable on the outer circumferential surface of said inner tube and is connected to said horn side.

12. The sonic soot blower according to claim 11, wherein the resonance tube having the slide mechanism is featured in that the length thereof is set to 1/6 through 1/10 or less of a wavelength formed by the sonic velocity and oscillation frequency at the compressed air temperature at the outlet of the sonic wave oscillator.

13. The sonic soot blower according to claim 11, wherein said horn is surrounded by a heat-shielding attachment box installed at one end in an opening of a wall surface of the soot blower-installed equipment, and said resonance tube equipped with a slide mechanism and sonic wave oscillator are surrounded by a sonic wave oscillator casing provided adjacent to a second end of said attachment box.

14. The sonic soot blower according to claim 13, wherein said heat-shielding attachment box and sonic wave oscillator casing are covered by heat-shielding and/or soundproof lagging.

15. The sonic soot blower according to claim 11, wherein said sonic wave oscillator comprises a means for oscillating sonic waves by steam, said sonic wave oscillator is internally incorporated in a heat-shielding attachment box installed in an opening in a wall surface of the soot blower-installed equipment together with a horn, a part of said resonance tube is formed to be U-shaped and tubular, and said U-shaped and tubular portion is disposed outside said heat-shielding attachment box.

16. The sonic soot blower according to claim 15, wherein said resonance tube comprises a U-shaped inner tube and a straight outer tube that is slidable on the outer circumferential surface of said inner tube.

17. The sonic soot blower according to claim 1, further comprising:

a heat-shielding attachment box internally incorporating the horn, installed in an opening of a wall surface of said soot blower-installed equipment; and a gas flow channel for conducting a gas exhausted from the outlet of the gas flowing in said soot blower-installed equipment into said heat-shielding attachment box or atmosphere, and for using said gas or air to cool the inside of said heat-shielding attachment box.

18. The sonic soot blower according to claim 17, wherein a heat-shielding attachment box internally incorporating a horn and a sonic wave oscillator casing internally incorporating a frequency-regulating portion equipped with a resonance tube having a gas mixer and/or a slide mechanism are provided adjacent to each other; a communicating portion that communicates with the atmospheric air via a check valve is provided at the wall surface, in contact with the atmospheric air, of said sonic wave oscillator casing; a communicating portion that causes both said heat-shielding attachment box and said sonic wave oscillator casing to communicate with each other via a check valve is provided at the boundary between both the box and casing; and further a compressive gas supply flow channel equipped with a needle valve is provided in said sonic wave oscillator casing.

19. The sonic soot blower according to claim 18, wherein a drive portion of the frequency-regulating portion is disposed further outside the sonic wave oscillator casing internally incorporating said frequency-regulating portion; a drive portion casing to cover said drive portion is provided; a communicating portion that causes said drive portion casing and said sonic wave oscillator casing to communicate with each other via a check valve is provided at the boundary portion between both the casings; and a communicating portion that communicates with the atmospheric air via the check valve is provided is further installed at the wall surface in contact with said drive portion casing and the atmospheric air.

20. The sonic soot blower according to claim 17, wherein a gas inflow preventing damper that is able to be opened and closed is provided in the opening, at soot blower-installed equipment side, of a heat-shielding attachment box internally incorporating a horn.

21. A method for operating sonic soot blowers using the sonic soot blowers according to claim 19, comprising the steps of:

preventing an in-furnace gas from flowing into each of the sonic soot blower by causing the atmospheric air or a gas flowing in the sonic soot blower-installed equipment to flow into each of the sonic soot blower via respective communicating portions of the drive portion casing of a frequency-regulating portion, sonic wave oscillator casings and heat-shielding attachment box when normally operating said sonic soot blower in soot blower-installed equipment whose inner pressure is lower than the atmospheric pressure in normal operations; and simultaneously cooling the frequency-regulating portion, drive portion of the frequency-regulating portion, sonic wave oscillator, resonance tube and horn by the atmospheric air passing through said respective communicating portions or a gas flowing through said soot blower-installed equipment.

22. A method for operating sonic soot blowers using the sonic soot blowers according to claim 19, further comprising the step of supplying a compressive gas into each of said sonic wave oscillator casing through a compressive gas supply flow channel equipped with a needle valve when stopping the operation of said soot blower-installed equipment when operating said sonic soot blower in soot blower-installed equipment whose inner pressure is lower than the atmospheric pressure in normal operations.

23. A method for operating sonic soot blowers using the sonic soot blowers according to claim 20, comprising the step of interrupting each of the sonic soot blower and the inside of the soot blower-installed equipment by closing a gas inflow preventing damper installed in the opening, at the soot blower-installed equipment side, of the heat-shielding attachment box internally incorporating a horn in the case where carrying out maintenance work of the sonic sooth blower when operating the sonic soot blower in soot blower-installed equipment whose inner pressure is lower than the atmospheric pressure in normal operations.

24. A method for operating a plurality of sonic soot blowers comprising the steps of:

installing gas thermometers at an outlet and inlet of a gas flowing in soot blower-installed equipment in which a plurality of members are provided, respectively;

installing a dust monitor for measuring the dust density in the gas at said outlet;

oscillating sonic waves of various frequencies differing from each other into said soot blower-installed equipment by frequency-variable type or frequency-fixed type sonic soot blowers, each of which is provided with a sonic wave oscillator internally incorporating an oscillation plate by using a compressive gas; a resonance tube for resonating the sonic waves oscillated by said sonic wave oscillator; and a horn for amplifying said sonic waves, all of which are installed in said soot blower-installed equipment; and checking by said dust monitor a situation where the dust density is increased and/or checking by said gas thermometer a situation where the gas temperature is lowered;

wherein a frequency is found, suited for each member corresponding to gas temperature conditions measured at designated areas in the soot-blower installed equipment, at which a strong effect can be brought about in removal of powdery dust adhered on said members or in prevention thereof from adhering to said members.

25. The method for operating sonic soot blowers according to claim 24, wherein operations of sonic wave oscillation and stopping thereof at the frequency which brings about a strong effect in removal of powdery dust adhered on said members or in prevention thereof from adhering to said members.

26. Soot blower-installed equipment comprising sonic soot blowers according to claim I attached to the wall surface thereof.

27. The soot blower-installed equipment according to claim 26, wherein a plurality of stages of sonic soot blowers are disposed in the gas flow direction, and sonic soot blowers, whose sonic pressure are increased from the upstream stage of the gas flow in a plurality of stages of layers toward the downstream stage thereof, are disposed in the vicinity of the respective layers.

28. The soot blower-installed equipment according to claim 26, wherein the sonic soot blowers are installed in the vicinity of portions where gas drift are remarkable in the extreme upstream stage of layers in the gas flow in a plurality of stages of layers in the soot blower-installed equipment.

29. The soot blower-installed equipment according to claim 26, wherein said soot blower-installed equipment is a boiler furnace, a denitration apparatus, a waste heat recovery boiler or a heat accumulation type heat exchanger.

30. A sonic soot blower generating fixed frequency waves comprising a sonic wave oscillator internally incorporating an oscillation plate to be oscillated by using a compressive gas, a resonance tube, connected downstream to the sonic wave oscillator, for resonating the sonic waves oscillated by said sonic wave oscillator and a horn, connected downstream to the resonance tube, for amplifying the same, a heat-shielding attachment box internally incorporating the horn, installed so as to face the opening in a wall surface of soot blower-installed equipment, of a sonic soot blower a gas flow channel for causing a gas or atmospheric air exhausted from an outlet of the gas flowing through said soot blower-installed equipment to flow into said heat-shielding attachment box and a gas inflow preventing damper provided so as to be opened and closed in the opening, at the soot blower-installed equipment side, of the heat-shielding attachment box internally incorporating said horn.

31. The method for operating sonic soot blowers using the sonic soot blowers according to claim 30, comprising the step of interrupting each of the sonic soot blower and the inside of the soot blower-installed equipment by closing a gas inflow preventing damper installed in the opening, at the soot blower-installed equipment side, of the heat-shielding attachment box internally incorporating a horn in the case where carrying out maintenance work of the sonic sooth blower when operating the sonic soot blower in soot blower-installed equipment whose inner pressure is lower than the atmospheric pressure in normal operations.

32. Soot blower-installed equipment in which sonic soot blowers generating fixed frequency waves, having a sonic wave oscillator internally incorporating an oscillation plate to be oscillated by using a compressive gas, a resonance tube, connected downstream to the sonic wave oscillator, for resonating the sonic waves oscillated by said sonic wave oscillator and a horn, connected downstream to the resonance tube, for amplifying the same are provided on a wall surface thereof in a plurality of stages of layers in a gas flow direction, wherein a plurality of stages of sonic soot blowers are disposed in the gas flow direction, and sonic soot blowers, whose sonic pressure are increased from the upstream stage of the gas flow in a plurality of stages of layers toward the downstream stage thereof, are disposed in the vicinity of the respective layers.

33. The soot blower-installed equipment according to claim 32, wherein the sonic soot blowers are installed in the vicinity of portions where gas drift are remarkable in the extreme upstream stage of layers in the gas flow in a plurality of stages of layers in the soot blower-installed equipment.

34. The soot blower-installed equipment according to claim 32, wherein said soot blower-installed equipment is a boiler furnace, a denitration apparatus, a waste heat recovery boiler or a heat accumulation type heat exchanger.

* * * * *